US006295030B1

(12) United States Patent
Kozakai et al.

(10) Patent No.: US 6,295,030 B1
(45) Date of Patent: Sep. 25, 2001

(54) ANTENNA APPARATUS AND PORTABLE RADIO COMMUNICATION APPARATUS

(75) Inventors: Osamu Kozakai, Chiba; Masatoshi Sawamura, Saitama, both of (JP)

(73) Assignees: Sony Corporation, Tokyo (JP); Keio University, Tokyo (JP)

( * ) Notice: Subject to any disclaimer, the term of this patent is extended or adjusted under 35 U.S.C. 154(b) by 0 days.

(21) Appl. No.: 09/690,570

(22) Filed: Oct. 17, 2000

(30) Foreign Application Priority Data

Oct. 18, 1999 (JP) ..... 11-295434

(51) Int. Cl.[7] ..... H01Q 1/24; H01Q 1/38
(52) U.S. Cl. ..... 343/700 MS; 343/702
(58) Field of Search ..... 343/700 MS, 702, 343/846, 853; H01Q 1/24, 1/38

(56) References Cited

U.S. PATENT DOCUMENTS 6,061,024 * 5/2000 McGirr et al. ..... 343/700 MS

* cited by examiner

*Primary Examiner*—Hoanganh Le
(74) *Attorney, Agent, or Firm*—Jay H. Maioli

(57) ABSTRACT

In an antenna apparatus proposed by the present invention, two inverted-F antennas having the same characteristics are supplied with power with phase difference of 180 degrees respectively. Therefore only radio wave of polarized wave in a predetermined direction can be radiated and deterioration in antenna characteristics due to leak currents can be prevented.

16 Claims, 25 Drawing Sheets

ANTENNA APPARATUS AND PORTABLE RADIO COMMUNICATION APPARATUS

BACKGROUND OF THE INVENTION

1. Field of the Invention

The present invention relates to an antenna apparatus and a portable radio communication apparatus, and more particularly, is suitably applied to, for example, a compact portable radio communication apparatus.

2. Description of the Related Art

Conventionally, as shown in FIGS. 1A and 1B, a portable radio communication apparatus 1 in a digital portable telephone system of Personal Digital Cellular (PDC) system is configured to implement diversity reception with, for example, a whip antenna 2 and a plate-form inverted-F antenna 3, and thereby influence of phasing is reduced.

The whip antenna 2 is a line antenna being used as an antenna for transmission-reception installed from an upper surface of a box 4 approximately perpendicularly thereto, and is ordinarily selected to have length of around 1/4 wavelength to 1/2 wavelength. In addition, the whip antenna 2, which is brought into connection with a feed section 2A, is drawn out of interior of a box 4 at the time of communication (FIG. 1A), and is housed inside the box 4 when it is being carried (FIG. 1B).

The plate-form inverted-F antenna 3 is configured, as shown in FIG. 2, by comprising a rectangular radiation conductor 3A with a circumference length (L1×2+L2×2) being approximately 1/2 wavelength, a short-circuit section 3B to be short-circuited from one end of the above described radiation conductor 3A to a ground soil plate 5, and a feed pin 3D to bring a feed section 3C (FIGS. 1A and 1B) and the radiation conductor 3A into connection, and is ordinarily used as an antenna only for reception under a state that is built in the box 4.

In these whip antennas 2 as well as plate-form inverted-F antenna 3, transmission performance and reception performance are in reversible relationship, and unless otherwise notified later, transmission will be described, but reception will present similar characteristics.

Incidentally, in a thus configured portable radio communication apparatus 1 a whip antenna 2 is installed perpendicularly to the ground, and under this state, is arranged to oscillate radio wave of vertically polarized wave when transmission is implemented. On the other hand, an antenna in a cell station that communicates with the portable radio communication apparatus 1 also mainly utilizes vertically polarized wave so that the most excellent antenna characteristics will become available when polarized wave of both the parties correspond.

That is, as shown in FIG. 3, in the case where a portable radio communication apparatus 1 is used under a state that it stands straight up, polarized waves correspond so that good communication is implemented with respect to a cell station 7, but in the case where the portable radio communication apparatus 1 is applied to a user's ear under a state of inclining by approximately 60 degrees for use as at the time of communication, polarized waves do not correspond, giving rise to a problem that good communication is not implemented with respect to the cell station 7 due to deteriorated antenna characteristics.

Incidentally, as a method to cause polarized wave to correspond with polarized wave from the cell station 7 when the portable radio communication apparatus 1 at the time of communication remains under a state of inclining by approximately 60 degrees, it is considered that a whip antenna 2 should be caused to incline, but in this case, housing structure at the time when the apparatus is being carried gets complicated and does not provide good appearance in the visual standpoint for practical use.

In addition, as for the portable radio communication apparatus 1 (FIGS. 1A and 1B), feeding to the whip antenna 2 is implemented by a feed section 2A provided in an upper end section of the box 4, and therefore high frequency current flows out not only to a line antenna of the whip antenna 2 but also to the ground soil plate 5, and consequently, radio wave will be divided for radiation to the line antenna portion and the ground soil plate 5.

Actually, as shown in FIGS. 4A and 4B, the portable radio communication apparatus 1 will bring about current distribution shown by broken lines in the case where the whip antenna 2 is selected to have 1/4 wavelength or 3/8 wavelength so that radio wave is divided for distribution to the line antenna portion and the ground soil plate 5 and radiated.

Accordingly, with the portable radio communication apparatus 1, the ground soil plate 5 comes closer to human head section than the line form portion of the whip antenna 2 at the time of communication, and therefore radio wave to be radiated by leak current having flown out to the ground soil plate 5 will be strongly affected by human body, and consequently, antenna characteristics used to be deteriorated.

In addition, in order to prevent current from flowing out to the ground soil plate 5, it is considered that the line form portion of the whip antenna 2 is selected to have length of 1/2 wavelength, giving rise to, however, in this case, current distribution as shown in FIG. 4C so that any leak current can be prevented from flowing to the ground soil plate 5, nevertheless, the line antenna portion will become too much long.

Moreover, in the portable radio communication apparatus 1, as shown in FIG. 5, a plate-form inverted-F antenna 3 is installed in the position very near the ground soil plate 5, and therefore, current 5i1 flowing into the plate-form inverted-F antenna 3 will induce leak current 5i2 in the ground soil plate 5 that will flow in the vertical direction in large quantity, and thereby radio wave of vertically polarized wave is radiated dominantly.

Thereby, in the case where the portable radio communication apparatus 1, as at the time of communication, is used under a state of inclining by approximately 60 degrees, as with the above described whip antenna 2, polarized waves do not correspond with polarized waves from the cell station, giving rise to such problems that antenna characteristics are deteriorated, and at the same time radio wave radiated by leak current flowing out to the ground soil plate 5 is strongly influenced by a human body to deteriorate antenna characteristics.

Incidentally, as a method to attain excellent diversity effects, space diversity utilizing difference in installation point of antenna, angle diversity utilizing difference in directivity of antenna, and polarization diversity utilizing difference in polarization of antenna are generally well known.

However, the portable radio communication apparatus 1 has vertically polarized wave as its main polarized wave both for the whip antenna 2 and the plate-form inverted-F antenna 3, making effects due to polarization diversity hardly expectable. In addition, the portable radio communication apparatus 1 undergoes miniaturization, and in turn effects of space diversity drop while, as for effects of directional diversity, difficulty in giving any directivity with small antenna brings about such a problem that certain diversity effects remain unavailable.

Moreover, the portable radio communication apparatus 1 suffers from such a problem that leak current 5i2 (FIG. 5) in the vertical direction induced when current 5i1 is caused to flow to the plate-form inverted-F antenna 3 gets together with leak current flowing out to the ground soil plate 5 when a current is caused to flow into the whip antenna 2 to influence each other to deteriorate the antenna characteristics.

SUMMARY OF THE INVENTION

In view of the foregoing, an object of this invention is to provide an antenna apparatus and a portable radio communication apparatus showing good antenna characteristics also at the time of communication.

The foregoing objects and other objects of the invention have been achieved by the provision of an antenna apparatus which comprises a ground conductor, a first plate-form inverted-F antenna that is configured by comprising a first radiation conductor, a first feed section to supply the above described first radiation conductor with power, and a first short-circuit section to bring the first radiation conductor and the ground conductor into short circuit, and a second plate-form inverted-F antenna that is configured by comprising a second radiation conductor having the same characteristics as the first radiation conductor, a second feed section to supply the second radiation conductor disposed in the vicinity of the first feed section with power with phase difference of 180 degrees with respect to the first feed section, and a second short-circuit section to be disposed in the vicinity of the first short-circuit section and to bring the second radiation conductor and the ground conductor into short circuit are arranged to be installed.

Thereby, it is possible to intensify only the current component flowing in a first radiation conductor and a second radiation conductor in a predetermined direction and cancel currents flowing in the ground conductor to prevent leak current from taking place, and therefore it is possible to radiate only radio wave of polarized wave in a predetermined direction to prevent deterioration in antenna characteristics due to leak currents.

Furthermore, in the present invention, in a portable radio communication apparatus having an antenna apparatus comprising a first antenna and a second antenna to implement polarized wave diversity, the above described first antenna comprising a ground conductor, a first plate-form inverted-F antenna that is configured by comprising a first radiation conductor, a first feed section to supply the above described first radiation conductor with power, and a first short-circuit section to bring the first radiation conductor and the ground conductor into short circuit, and a second plate-form inverted-F antenna that is configured by comprising a second radiation conductor having the same characteristics as the first radiation conductor, a second feed section to supply the second radiation conductor disposed in the vicinity of the first feed section with power with phase difference of 180 degrees with respect to the first feed section, and a second short-circuit section to be disposed in the vicinity of the first short-circuit section and to bring the second radiation conductor and the ground conductor into short circuit and the above described second antenna to radiate radio wave of polarized wave different from the above described first antenna are arranged to be installed.

Thereby, it is possible to intensify only the current component flowing in a first radiation conductor and a second radiation conductor in a predetermined direction and cancel currents flowing in the ground conductor to prevent leak current from taking place, and therefore it is possible to radiate only radio wave of polarized wave in a predetermined direction to prevent deterioration in antenna characteristics due to leak currents, and in the second antenna, radio wave of polarized wave different from that of the first antenna can be radiated so that the first antenna and the second antenna can make an excellent polarized wave diversity effect attainable.

The nature, principle and utility of the invention will become more apparent from the following detailed description when read in conjunction with the accompanying drawings in which like parts are designated by like reference numerals or characters.

DETAILED DESCRIPTION OF THE EMBODIMENT

Preferred embodiments of this invention will be described with reference to the accompanying drawings:

(1) First Embodiment

Figure 6:
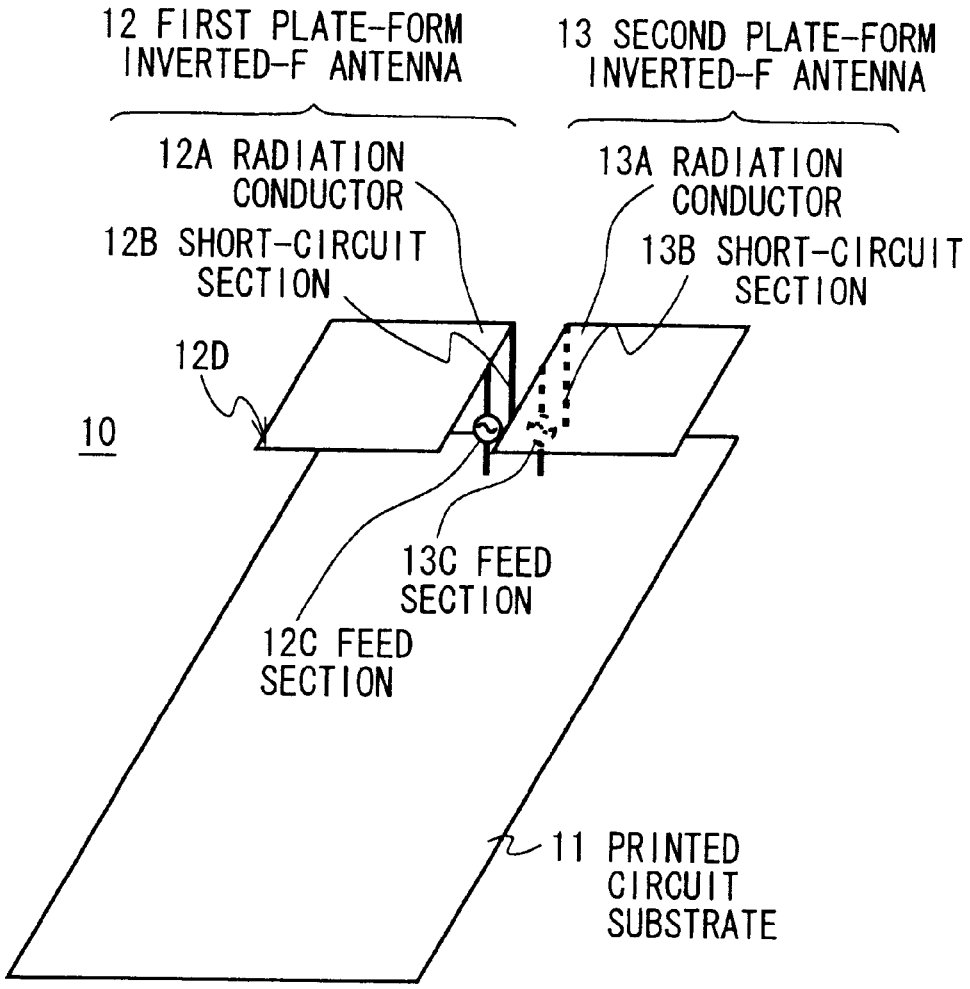
FIG. 6 is a perspective outlined view showing a configuration of an antenna apparatus in a first embodiment according to the present invention.

In FIG. 6, reference numeral 10 denotes an antenna apparatus of a first embodiment in its entirety in the present invention, which is configured by comprising a printed circuit substrate 11 as a ground conductor on which various circuits to implement transmission and reception as a portable radio communication apparatus are mounted, a first plate-form inverted-F antenna 12 as well as a second plate-form inverted-F antenna 13 disposed almost in parallel with the above described printed circuit substrate 11.

The first plate-form inverted-F antenna 12 is arranged to have a radiation conductor 12A being rectangular of approximately 1/2-wavelength electrical length to be set for its circumference length so as to implement resonance, and is arranged to cause the above described radiation conductor 12A and a printed circuit substrate 11 to short-circuit with a short-circuit section 12B brought into connection with an upward right end of the radiation conductor 12A, and to supply the radiation conductor 12A with power from the printed circuit substrate 11 with a feed section 12C.

Here, the feed section 12C is installed in the most suitable position so as to bring input impedance at the time when a power is supplied to the radiation conductor 12A into matching with various circuits of the printed circuit substrate 11.

Incidentally, an end section 12D of the radiation conductor 12A located farthest from the feed section 12C is with high impedance since no more current flows and a short-circuit point that is brought into connection with a short-circuit section 12B of the radiation conductor 12A is with low impedance of almost 0Ω. Accordingly, the antenna apparatus 10 is adjusted to have most appropriate input impedance by moving the feed section 12C within a range from a high impedance position to a low impedance position.

A second plate-form inverted-F antenna 13, that has a shape in bilateral symmetry with the first plate-form inverted-F antenna 12, is arranged to have, as in the first plate-form inverted-F antenna 12, a radiation conductor 13A being rectangular of approximately 1/2-wavelength electrical length to be set for its circumference length so as to implement resonance, and is arranged to cause the above described radiation conductor 13A and a printed circuit substrate 11 to short-circuit with a short-circuit section 13B brought into connection with an upward left end of the radiation conductor 13A, and to supply the radiation conductor 13A with power from the printed circuit substrate 11 with a feed section 13C.

Figure 7A:
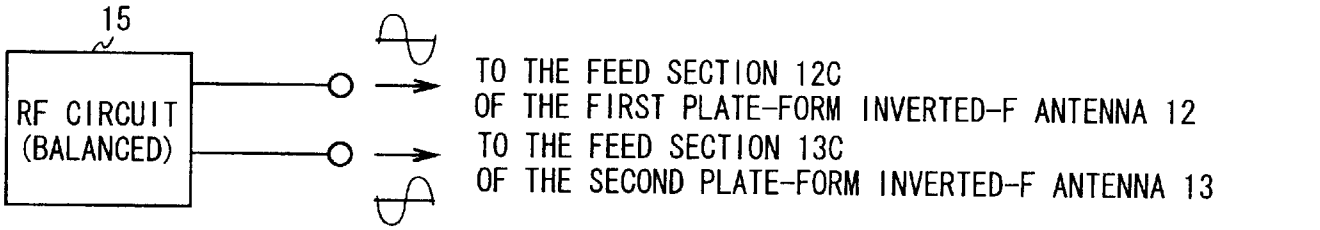
FIGS. 7A and 7B are perspective outlined views to be served for describing a method of feeding.

At this time, as shown in FIG. 7A, when an RF circuit 15 of the printed circuit substrate 11 is balanced, the feed sections 12C and 13C respectively of the first plate-form inverted-F antenna 12 and the second plate-form inverted-F antenna 13 are provided with feeding having phase difference of 180 degrees.

Figure 7B:
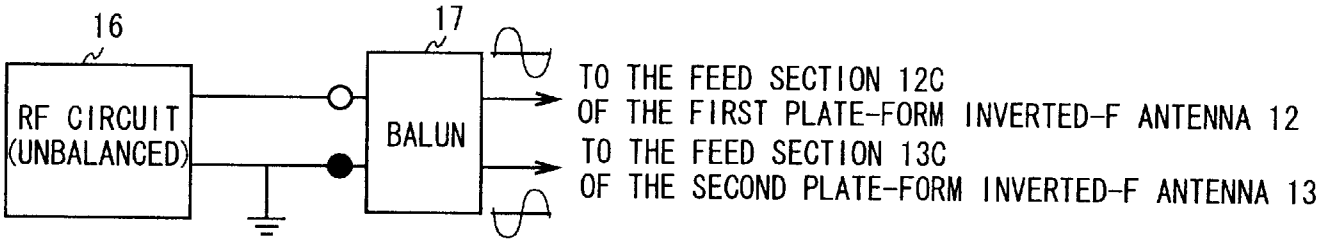

On the contrary, as shown in FIG. 7B, when the RF circuit 16 of the printed circuit substrate 11 is not balanced, feeding having phase difference of 180 degrees is arranged to be provided to the feed sections 12C and 13C via a phase circuit using a concentrated constant or distributed constant such as a balun 17.

Figure 8:
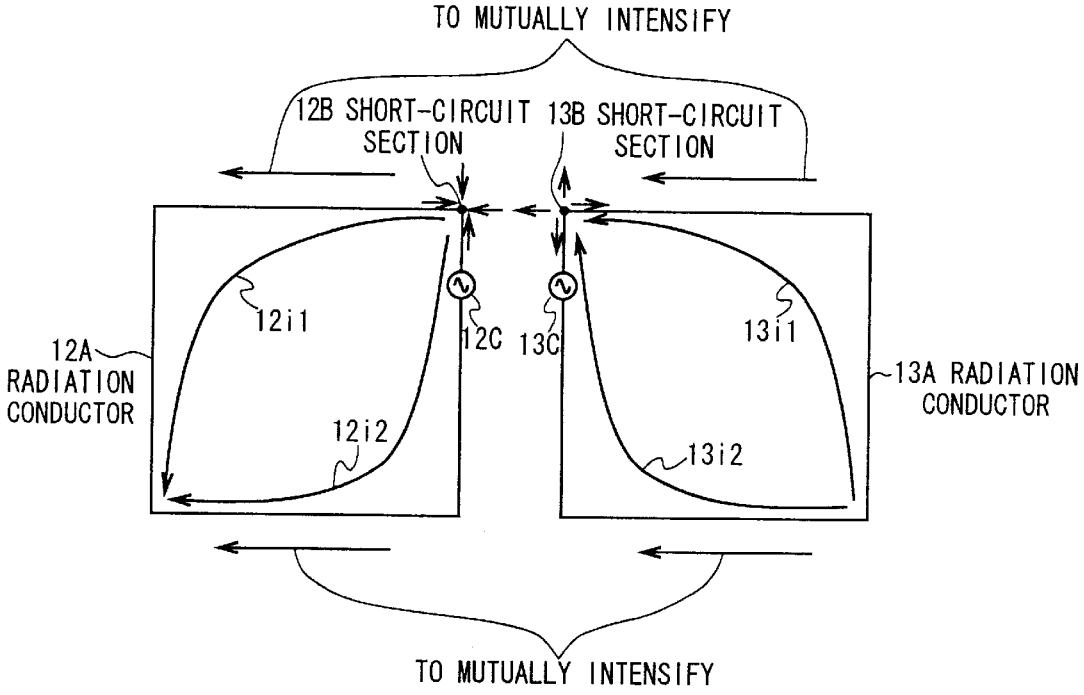
FIG. 8 is a perspective outlined view to be served for describing current component in the horizontal direction to be multiplied by a first and a second plate-form inverted-F antenna.

Actually, as for the antenna apparatus 10, as shown in FIG. 8, when the feed section 12C of the first plate-form inverted-F antenna 12 and the feed section 13C of the second plate-form inverted-F antenna 13 are provided with feeding having phase difference of 180 degrees, for a moment, a current component 12i1 flowing in the radiation conductor 12A and a current component 13i1 flowing in the radiation conductor 13A intensify each other in the horizontal direction, and in addition, a current component 12i2 flowing in the radiation conductor 12A and a current component 13i2 flowing in the radiation conductor 13A intensify each other in the horizontal direction. Thereby current components flowing in two sheets of radiation conductors 12A and 13A will be multiplied only in the horizontal direction.

Incidentally, between current components flowing in two sheets of the radiation conductors 12A as well as 13A, current component 12i2 and current component 13i1 cancel each other in the vertical direction, and current component 12i1 and current component 13i2 cancel each other in the vertical direction so that current component in the vertical direction will become weak by far.

In addition, as for the antenna apparatus 10, the next moment, when the direction of current flowing in the radiation conductor 12A as well as the radiation conductor 13A is inverted, also at this time, current components flowing in two sheets of the radiation conductors 12A and 13A are multiplied in the horizontal direction which is opposite from the aforementioned case, so that current component in the vertical direction will become weak by far.

Here, current flowing in the radiation conductors 12A as well as 13A will be accompanied by currents to flow also in the printed circuit substrate 11 being a ground conductor via the short-circuit section 12B as well as the short-circuit section 13B. That is, since current (current components 12i1 and 12i2) flows from the short-circuit section 12B to the radiation conductor 12A, current flows on the printed circuit substrate 11 with respect to the short-circuit section 12B, and in addition, since current (current components 13i1 and 13i2) flows on the radiation conductor 13A with respect to the short-circuit section 13B, current flows on the printed circuit substrate 11 from the short-circuit section 13B.

Figures 1A, 1B:
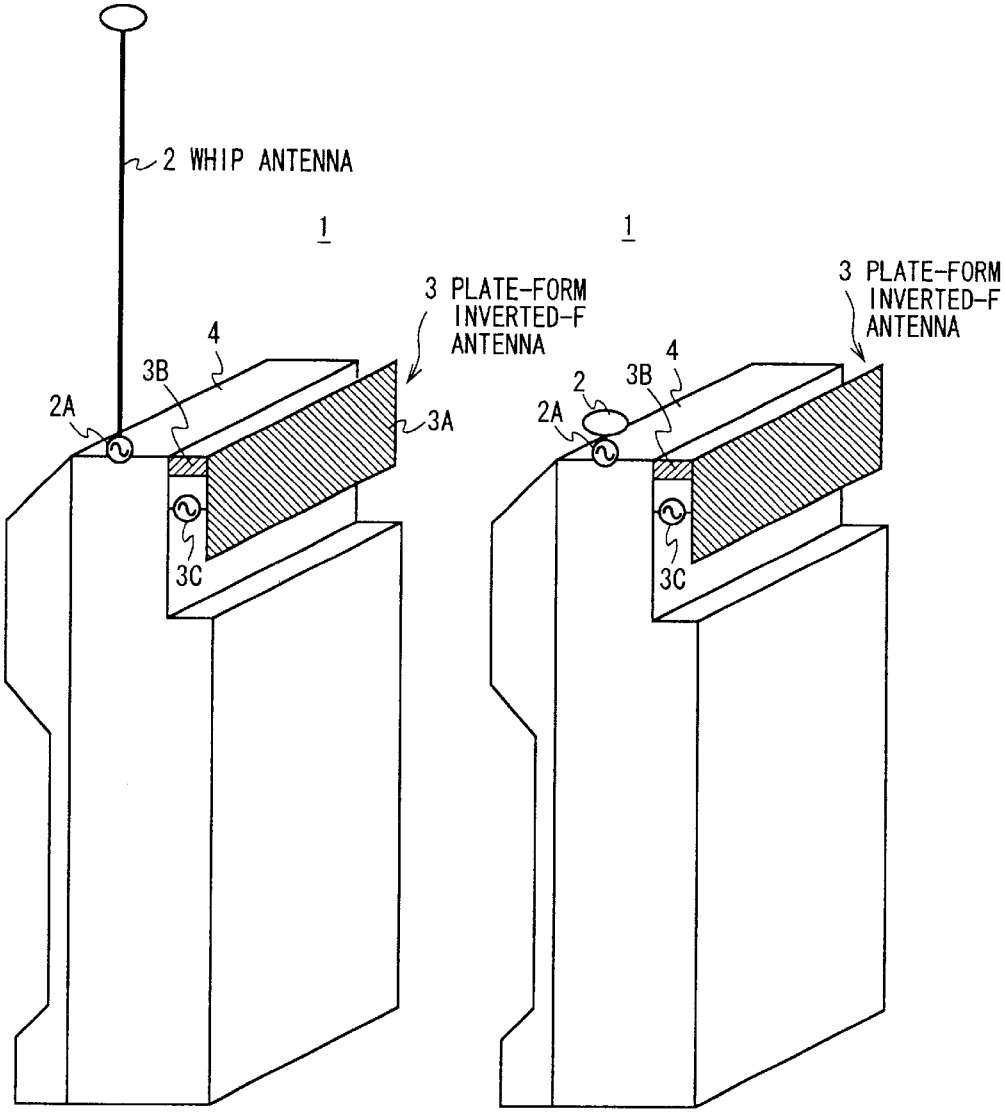
FIG. 1A(PRIOR ART) FIG. 1B(PRIOR ART)
FIGS. 1A and 1B are perspective outlined views showing a configuration of a conventional portable radio communication apparatus.
Figure 2:
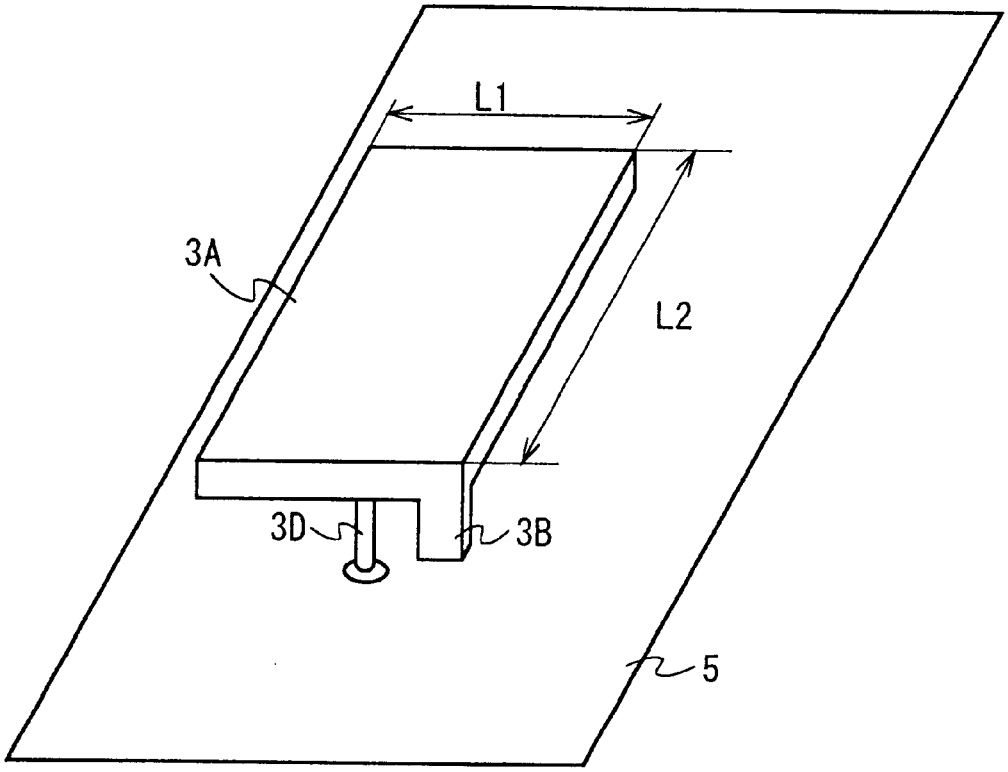
FIG. 2(PRIOR ART)
FIG. 2 is a perspective outlined view showing a configuration of a conventional plate-form inverted-F antenna.

Thereby, as for the antenna apparatus 10, current components flowing on the printed circuit substrate 11 with the short-circuit sections 12B and 13B as a center will almost completely cancel each other as a whole so that such an incident that leak current is generated on the printed circuit substrate 11 as in a conventional plate-form inverted-F antenna 3 (FIGS. 1A and 1B) will be preventable.

Figure 9:
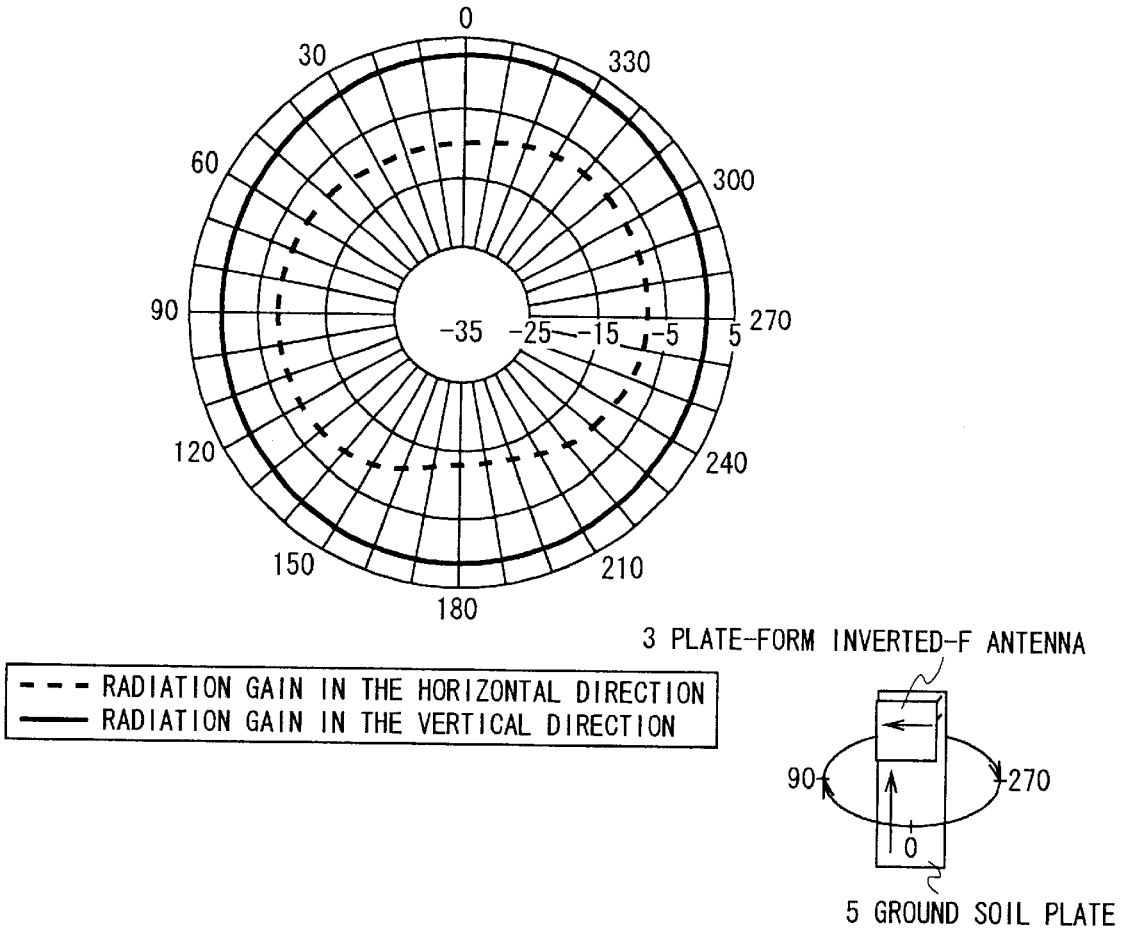
FIG. 9 is a graph featuring characteristic curves showing radiation gain by a conventional plate-form inverted-F antenna.

Here, as shown in FIG. 9, assessment on the radiation gain of radio wave within a horizontal plane obtained by the plate-form inverted-F antenna 3 at the time when a conventional portable radio communication apparatus 1 is erected, the radiation gain being divided into vertically polarized wave component and horizontally polarized wave component, reveals that current in the vertical direction flowing much on the ground soil plate 5 induced by the plate-form inverted-F antenna 3 makes almost non-directional radiation characteristics available with the main polarized wave being vertically polarized wave and with high radiation gain.

Figure 10:
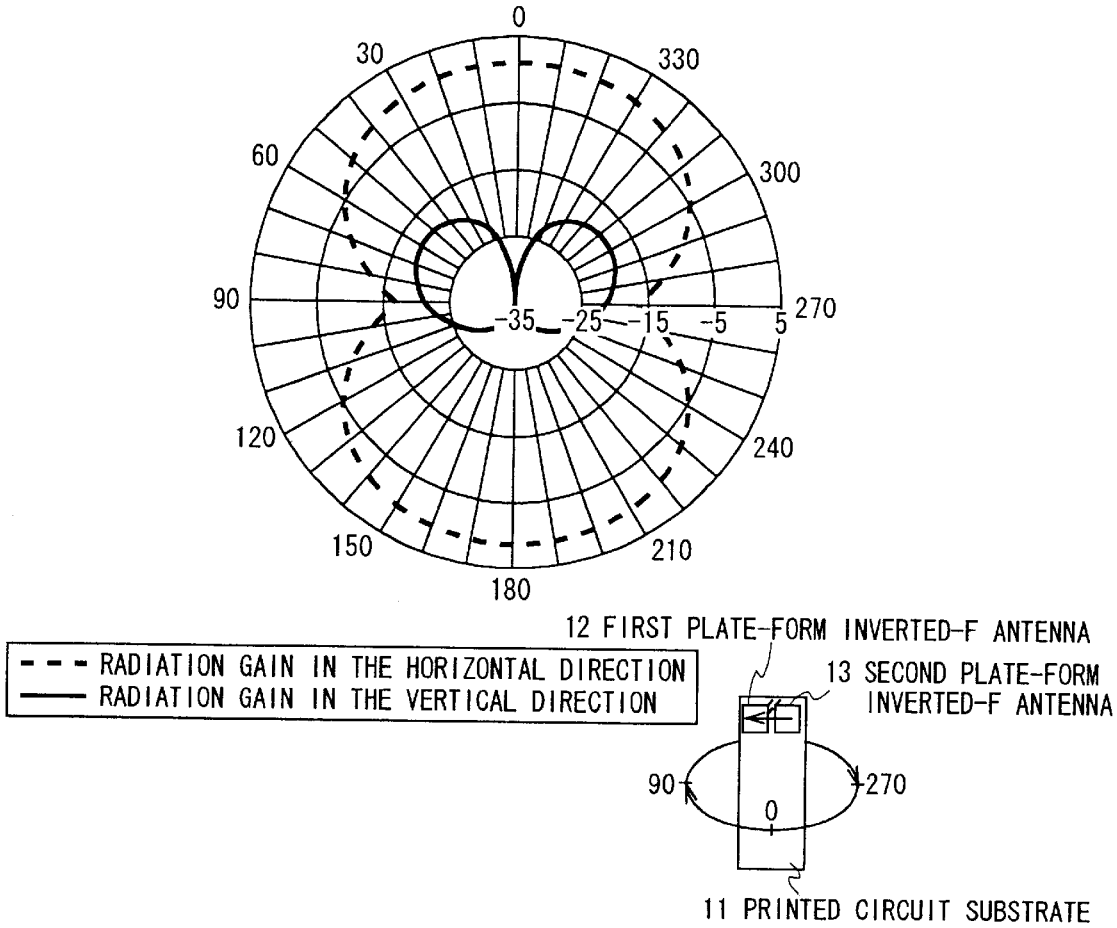
FIG. 10 is a graph featuring characteristic curves showing radiation gain by an antenna apparatus of the present invention.

On the other hand, as in FIG. 10, assessment on the radiation gain of radio wave within a horizontal plane obtained by the first plate-form inverted-F antenna 12 and the second plate-form inverted-F antenna 13 at the time when an antenna apparatus 10 of the present invention is erected, the radiation gain being divided into vertically polarized wave component and horizontally polarized wave component, reveals that, since the first plate-form inverted-F antenna 12 as well as the second plate-form inverted-F antenna 13 mutually intensify currents in the horizontal direction, and leak current is not generated in the printed circuit substrate 11, few vertically polarized waves are radiated. It is furthermore revealed that current flowing in the first plate-form inverted-F antenna 12 and the second plate-form inverted-F antenna 13 in the horizontal direction makes available 8-form directional radiation characteristics with the main polarized wave being horizontally polarized waves that have high radiation gain in the front direction (0 degree) and in the rear direction (180 degrees)

Figure 11:
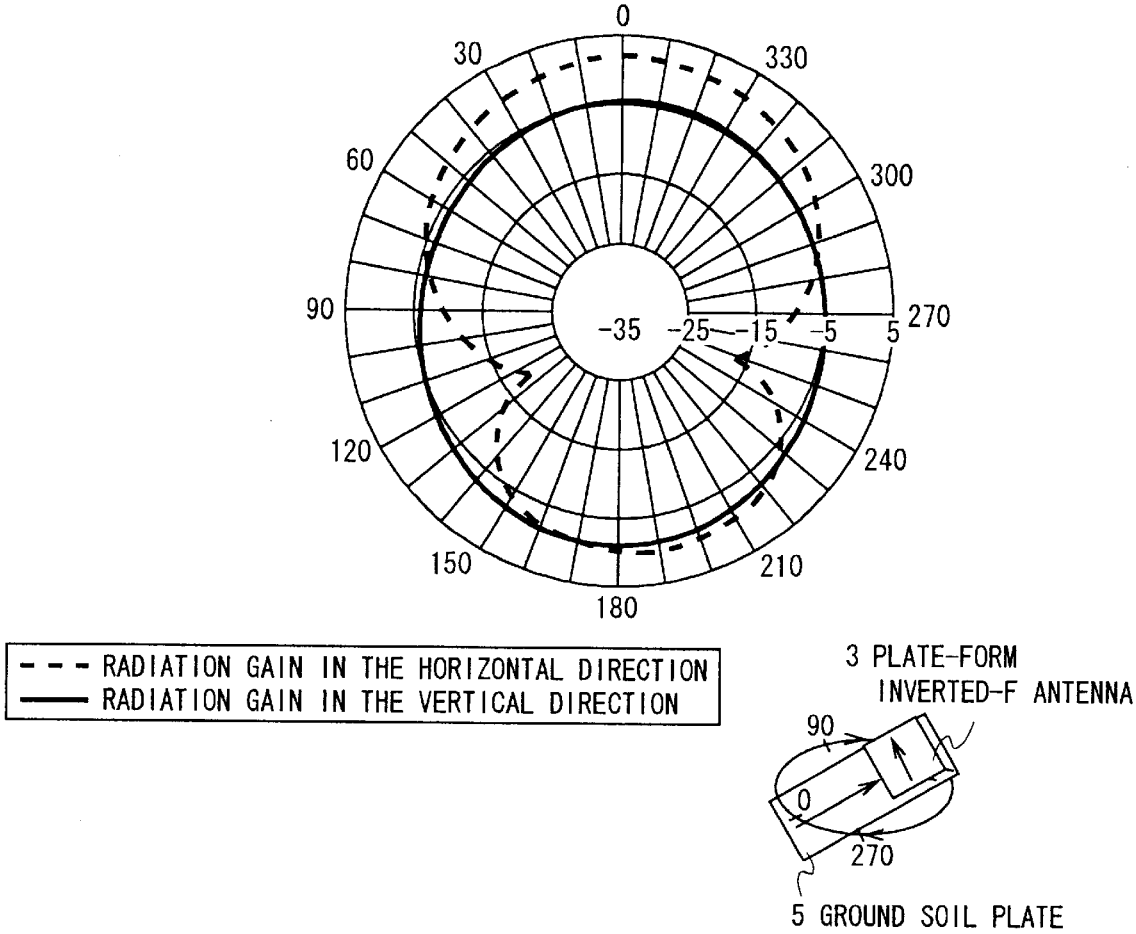
FIG. 11 is a graph featuring characteristic curves showing radiation gain at the time when a conventional plate-form inverted-F antenna is caused to incline by 60 degrees.

On the other hand, as shown in FIG. 11, when the conventional portable radio communication apparatus 1 is caused to incline by approximately 60 degrees as at the time of communication, current in the vertical direction that is induced on the plate-form inverted-F antenna 3 and flows much on the ground soil plate 5 resembles horizontally polarized wave so that, compared with the case when the apparatus is erected (FIG. 9), radiation gain of vertically polarized waves remains lower in its entirety.

Figure 12:
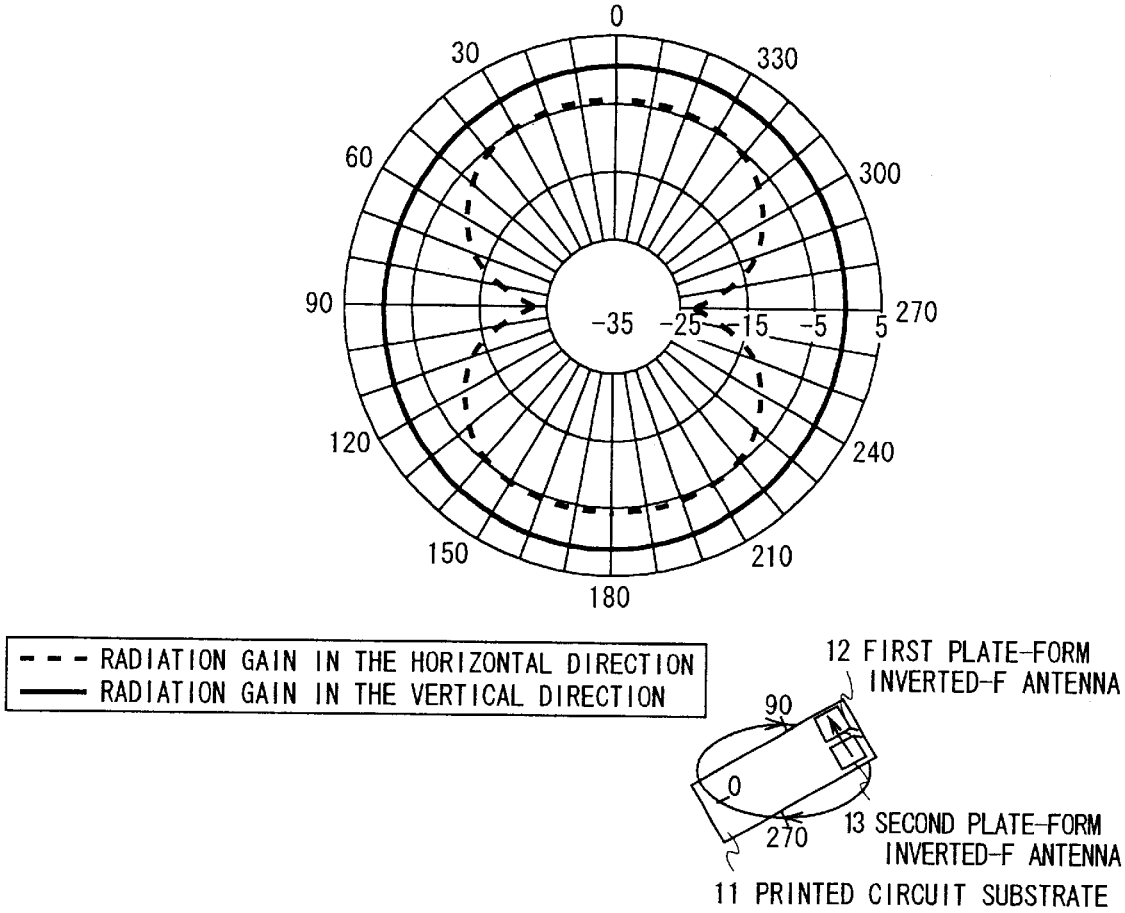
FIG. 12 is a graph featuring characteristic curves showing radiation gain at the time when an antenna apparatus of the present invention is caused to incline by 60 degrees.

On the other hand, as shown in FIG. 12, when the antenna apparatus 10 of the present invention is caused to incline by approximately 60 degrees as at the time of communication, since current in the horizontal direction multiplied by the first plate-form inverted-F antenna 12 as well as the second plate-form inverted-F antenna 13 comes closer to the vertical direction, compared with the case where the apparatus is erected (FIG. 10), almost non-directional radiation characteristics will be made available with vastly high radiation gain of vertically polarized wave.

Accordingly, comparison between the radiation gain of radio waves within a horizontal plane by a plate-form inverted-F antenna 3 at the time when the conventional portable radio communication apparatus 1 is caused to incline by approximately 60 degrees as shown in FIG. 11, and the radiation gain of radio waves within a horizontal plane by the first plate-form inverted-F antenna 12 and the second plate-form inverted-F antenna 13 at the time when the antenna apparatus 10 of the present invention shown in FIG. 12 is caused to incline by approximately 60 degrees will reveal that the antenna apparatus 10 of the present invention is provided with higher radiation gain of the vertically polarized wave in its entirety by approximately 5 dB.

Figure 3:
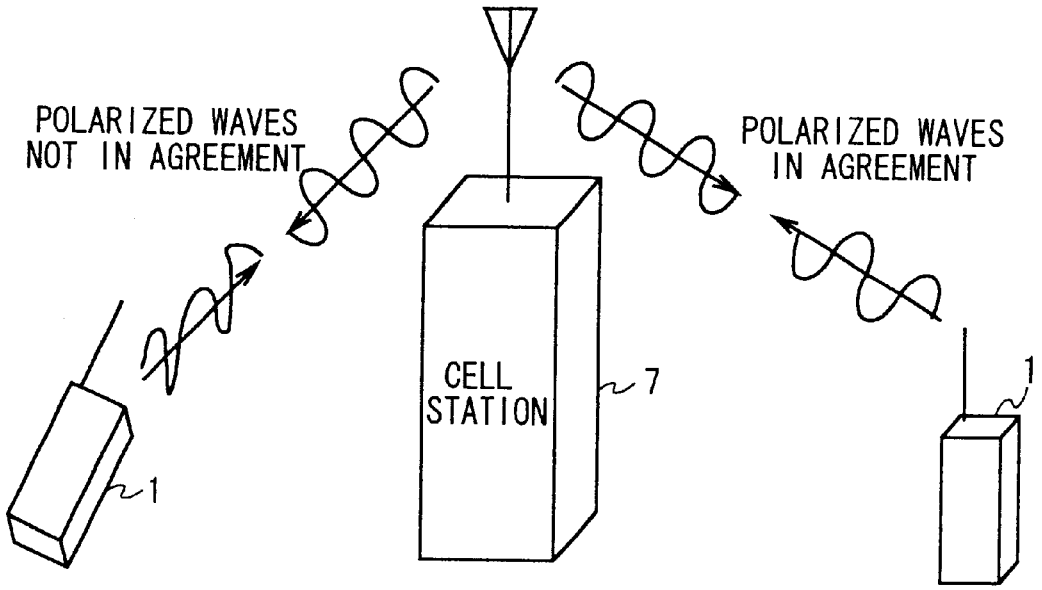
FIG. 3(PRIOR ART)
FIG. 3 is a perspective outlined view to be served for describing changes in antenna characteristics corresponding to polarized waves.
Figure 4A:
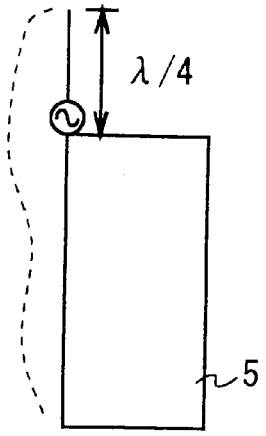
FIG. 4A(PRIOR ART)
FIGS. 4A to 4C are perspective outlined views showing current distribution corresponding to length of the whip antenna.
Figure 4B:
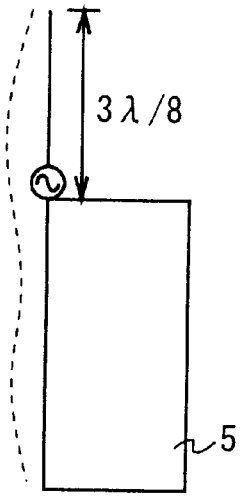
FIG. 4B(PRIOR ART)
Figure 4C:
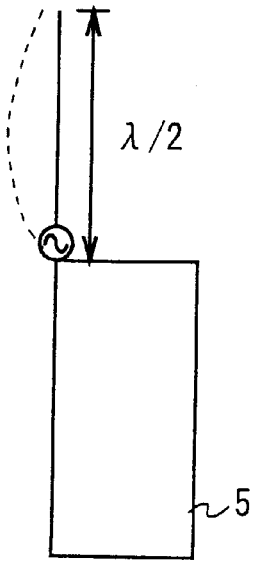
FIG. 4C(PRIOR ART)
Figure 5:
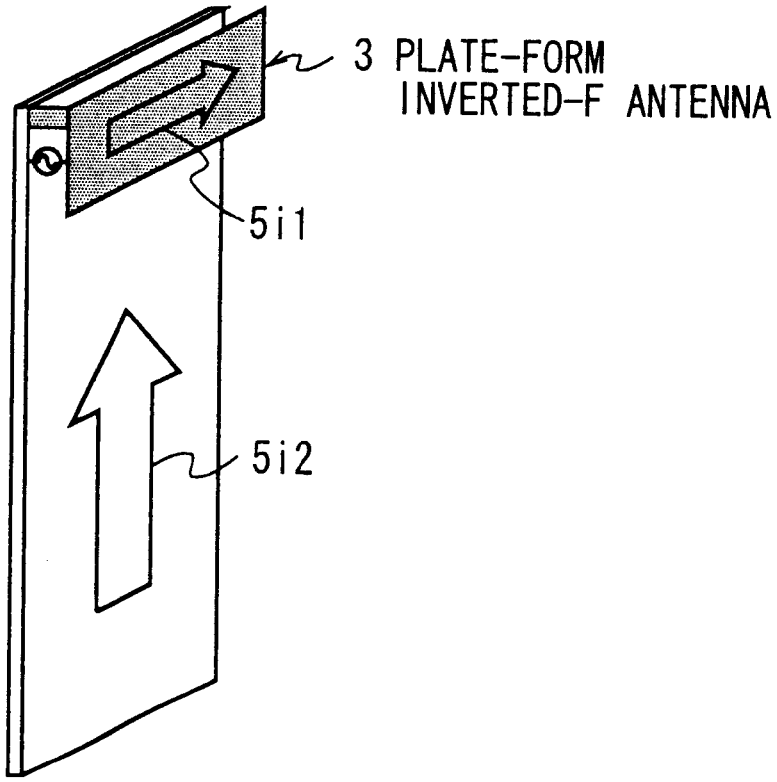
FIG. 5(PRIOR ART)
FIG. 5 is a perspective outlined view to be served for describing leak current induced by a plate-form inverted-F antenna.

That is, as for the antenna apparatus 10 of the present invention, when it is caused to incline by approximately 60 degrees, compared with the case where it is erected, polarized wave corresponds with that of the cell station 7 (FIG. 3), and in addition, vast improvement in radiation gain of the vertically polarized wave is arranged to make antenna characteristics at the time of communication further improvable.

Based on the configuration described so far, when the antenna apparatus 10 of the present invention is caused to incline by approximately 60 degrees, current in the horizontal direction multiplied by the first plate-form inverted-F antenna 12 as well as by the second plate-form inverted-F antenna 13 comes closer to the vertical direction so that radiation gain of vertically polarized waves that correspond with polarized waves of the cell station 7 gets vastly higher and antenna characteristics can be more improved at the time of communication.

In addition, as for the antenna apparatus 10, no leak current will flow in the vertical direction on the printed circuit substrate 11 so as not to be influenced by human bodies at the time of communication, and so as to prevent deterioration of antenna characteristics to realize good communication.

(2) Second Embodiment

Figure 13:
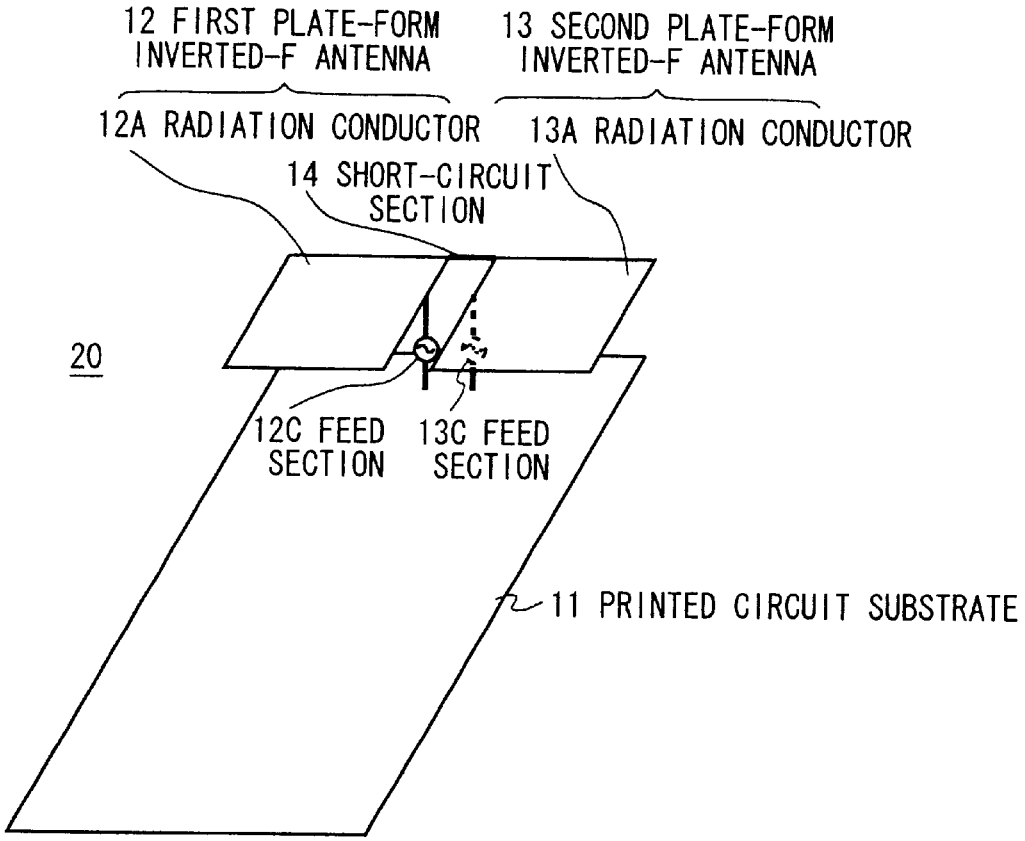
FIG. 13 is a perspective outlined view showing a configuration of an antenna apparatus in a second embodiment according to the present invention.

In FIG. 13 where the same reference numeral denotes its corresponding portion in FIG. 6, reference numeral 20 denotes an antenna apparatus of a second embodiment in its entirety in the present invention, which is configured, as in the aforementioned antenna apparatus 10 (FIG. 6), by comprising a first plate-form inverted-F antenna 12 as well as a second plate-form inverted-F antenna 13 disposed approximately parallel with a printed circuit substrate 11.

Here, in the aforementioned antenna apparatus 10 (FIG. 6), since the first plate-form inverted-F antenna 12 and the second plate-form inverted-F antenna 13 have approximately the same electrical characteristics and are supplied with power with mutually opposite phase, currents that flow into short-circuit sections 12B and 13B are approximately equal with mutually opposite phase and the potential difference with respect to the ground potential of printed circuit substrate 11 will become 0. Accordingly, in the antenna apparatus 10, also in the case where both of the short-circuit sections 12B and 13B are disconnected from the printed circuit substrate 11 and are brought into connection, it is considered that approximately the same operation will be implemented.

Therefore, the antenna apparatus 20 (FIG. 13) uses the same short-circuit point as in the short-circuit sections 12B and 13B of the antenna apparatus 10 so that the radiation conductor 12A and the radiation conductor 13A are arranged to be mutually short-circuited with the short-circuit section 14.

Thus, as for the antenna apparatus 20, the radiation conductor 12A and the radiation conductor 13A can be mutually short-circuited with the short-circuit section 14 so that the first plate-form inverted-F antenna 12 and the second plate-form inverted-F antenna 13 can be formed in an integrated configuration with reduced component counts and thus, configuration can be more simplified.

(3) Third Embodiment

Figure 14:
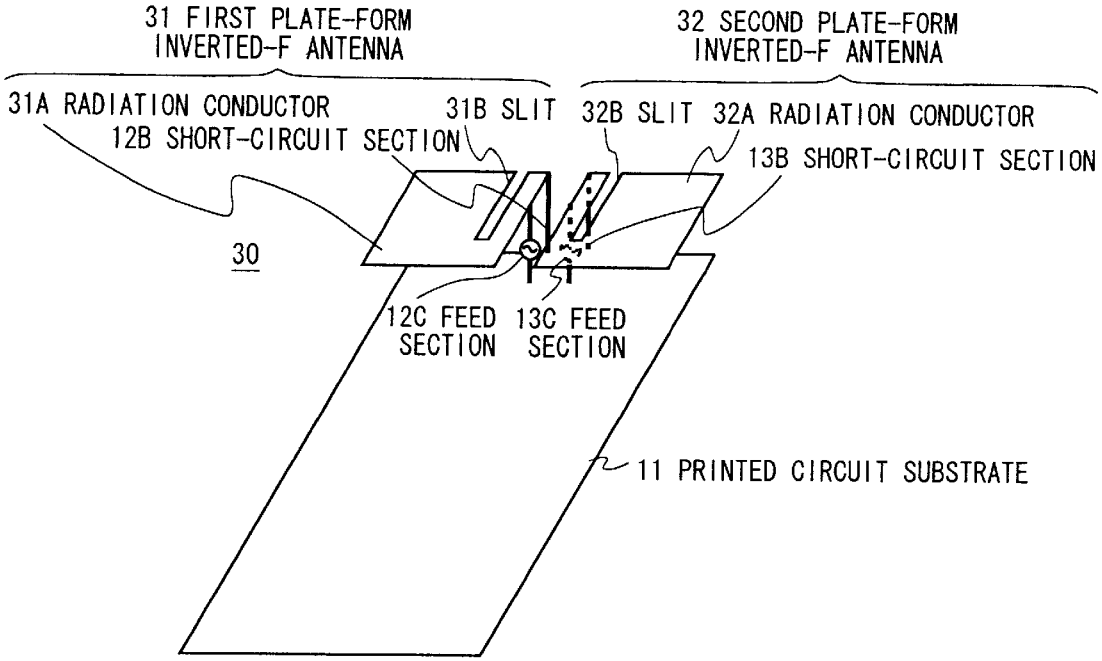
FIG. 14 is a perspective outlined view showing a configuration of an antenna apparatus in a third embodiment according to the present invention.

In FIG. 14 where the same reference numeral denotes its corresponding portion in FIG. 6, reference numeral 30 denotes an antenna apparatus of a third embodiment in its entirety in the present invention, which is configured, as in the aforementioned antenna apparatus 10 (FIG. 6), by comprising a printed circuit substrate 11 and a first plate-form inverted-F antenna 31 as well as a second plate-form inverted-F antenna 32 disposed approximately in parallel with the above described printed circuit substrate 11.

Furthermore, in the antenna apparatus 30, radiation conductors 31A and 32A respectively of the first plate-form inverted-F antenna 31 and the second plate-form inverted-F antenna 32 are provided with slits 31B and 32B resembling rectangular cutout.

At this time, the antenna apparatus 30 is provided with the slits 31B and 32B, enabling current flowing in the radiation conductors 31A and 32A to detour so as to be equivalent to reactance component loaded onto the radiation conductor 31A and 32A.

Accordingly, as for the antenna apparatus 30, capacity component among the radiation conductors 31A and 32A and the printed circuit substrate 11 can be made small for a component of loaded reactance, enabling the area of the radiation conductors 31A and 32A to be made small and to flexibly cope with further miniaturization.

Incidentally, the antenna apparatus 30 is arranged to provide the radiation conductors 31A and 32A with the slits 31B and 32B resembling rectangular cutouts, which will not limit shapes and counts on the slits 31A and 32A, but other various kinds of shapes and counts can be arranged to be provided.

(4) Fourth Embodiment

Figure 15:
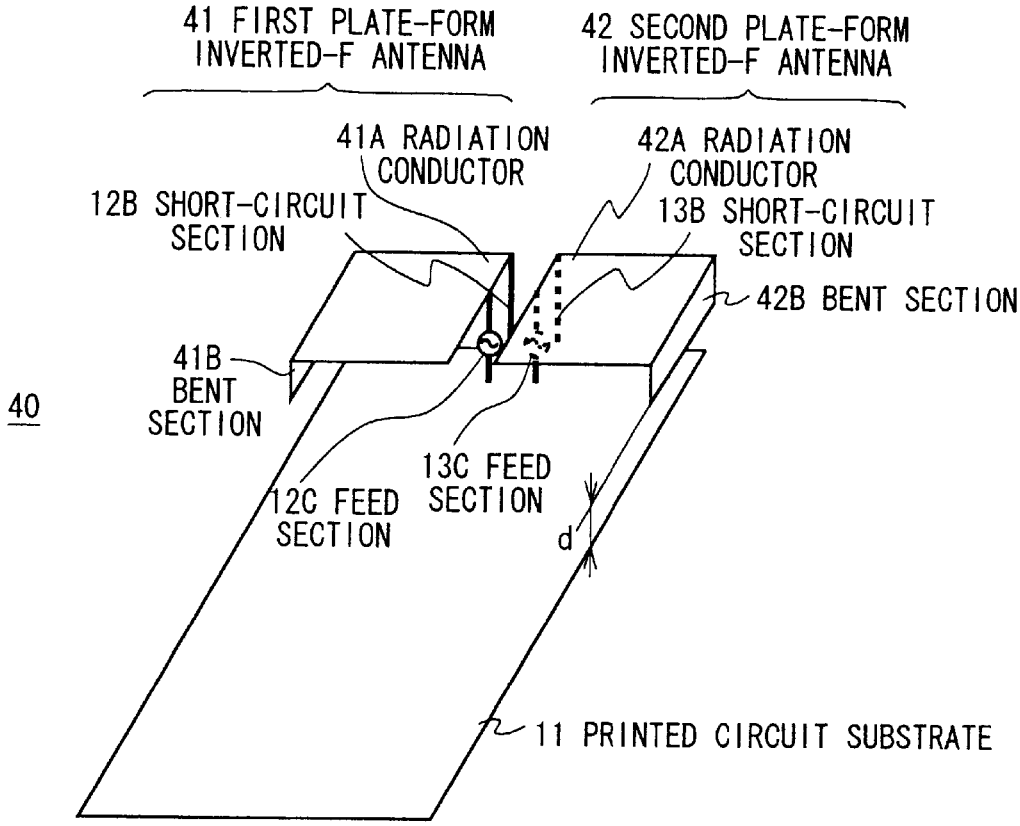
FIG. 15 is a perspective outlined view showing a configuration of an antenna apparatus in a fourth embodiment according to the present invention.

In FIG. 15 where the same reference numeral denotes its corresponding portion in FIG. 6, reference numeral 40 denotes an antenna apparatus of a fourth embodiment in its entirety in the present invention, which is configured, as in the aforementioned antenna apparatus 10 (FIG. 6), by comprising a printed circuit substrate 11 and a first plate-form inverted-F antenna 41 as well as a second plate-form inverted-F antenna 42 disposed approximately parallel with the above described printed circuit substrate 11.

Moreover, the antenna apparatus 40 is configured by providing side end sections of an external circumference of radiation conductors 41A and 42A respectively of the first plate-form inverted-F antenna 41 and the second plate-form inverted-F antenna 42 with bent sections 41B and 42B that have been bent by approximately 90 degrees with L-formed sectional view.

At this time, as for the antenna apparatus 40, the tips of the bent sections 41B and 42B will come close to the printed circuit substrate 11 with distance "d" so as to be equivalent to electrostatic capacity loaded between the tips of the bent section 41B and 42B and the printed circuit substrate 11.

In this case, as for the antenna apparatus 40, shorter the distance "d" between the tips of the bent section 41B and 42B and the printed circuit substrate 11 is, larger the electrostatic capacity gets, and therefore, the radiation conductors 31A and 32A are arranged to be capable of undergoing miniaturization based on loaded electrostatic capacity.

(5) Fifth Embodiment

Figure 16:
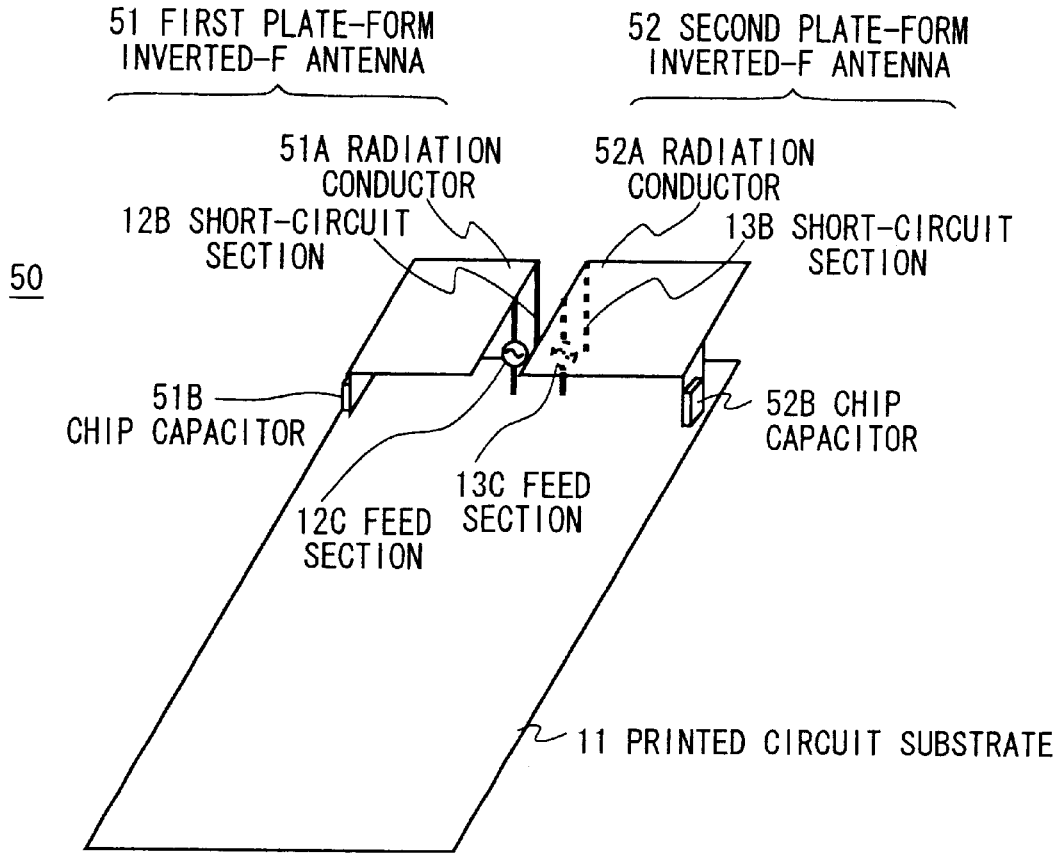
FIG. 16 is a perspective outlined view showing a configuration of an antenna apparatus in a fifth embodiment according to the present invention.

In FIG. 16 where the same reference numeral denotes its corresponding portion in FIG. 6, reference numeral 50 denotes an antenna apparatus of a fifth embodiment in its entirety in the present invention, which is configured, as in the aforementioned antenna apparatus 10 (FIG. 6), by comprising a printed circuit substrate 11 and a first plate-form inverted-F antenna 51 as well as a second plate-form inverted-F antenna 52 disposed approximately parallel with the above described printed circuit substrate 11.

In the antenna apparatus 50, side end sections of an external circumference of the radiation conductors 51A and 52A respectively of the first plate-form inverted-F antenna 51 and the second plate-form inverted-F antenna 52 are arranged to be brought into connection with chip capacitors 51A and 52A, which, thereby, are equivalent to loaded electrostatic capacity between the apparatus and the printed circuit substrate 11.

Accordingly, as for the antenna apparatus 50, as in the antenna apparatus 40 in the fourth embodiment, the electrostatic capacity gets large, and therefore, compared with the case where an electrostatic capacity is not loaded, the radiation conductors 51A and 52A are arranged to be capable of undergoing miniaturization for the portion of the loaded electrostatic capacity.

(6) Sixth Embodiment

Figure 17:
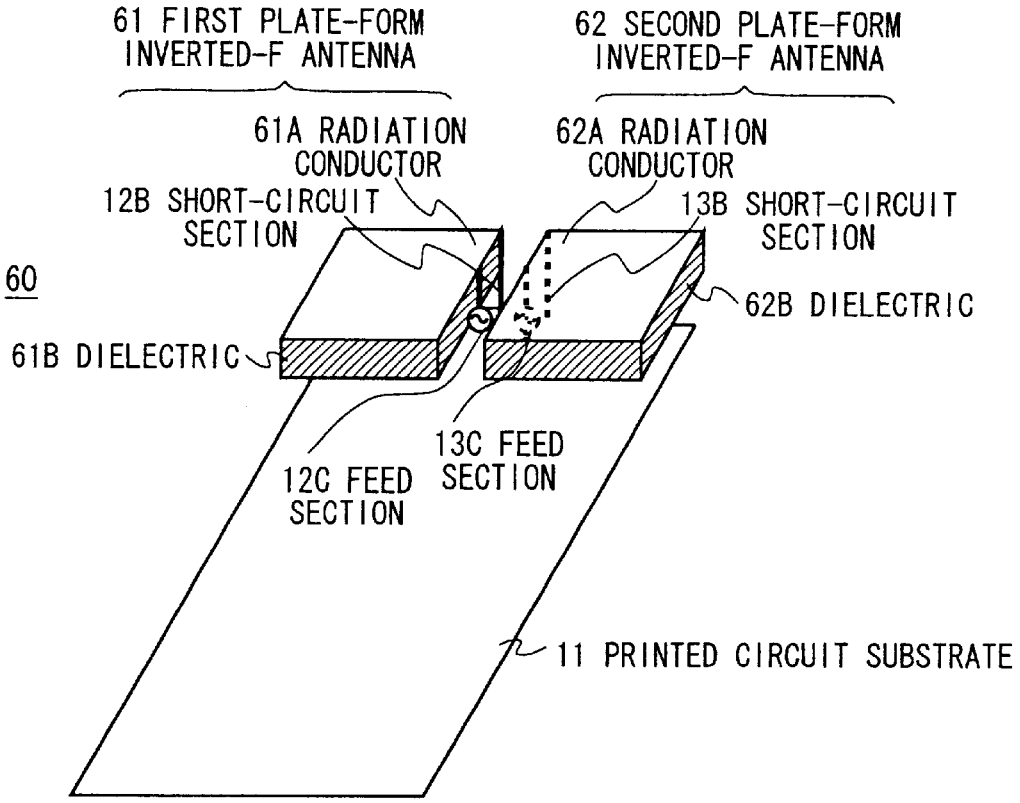
FIG. 17 is a perspective outlined view showing a configuration of an antenna apparatus in a sixth embodiment according to the present invention.

As shown in FIG. 17 where the same reference numeral denotes its corresponding portion in FIG. 6, reference numeral 60 denotes an antenna apparatus of a sixth embodiment in its entirety in the present invention, which is configured, as in the aforementioned antenna apparatus 10 (FIG. 6), by comprising, a printed circuit substrate 11 and a first plate-form inverted-F antenna 61 as well as a second plate-form inverted-F antenna 62 disposed approximately parallel with the above described printed circuit substrate 11.

In the antenna apparatus 60, space between the radiation conductors 61A and 62A respectively of the first plate-form inverted-F antenna 61 and the second plate-form inverted-F antenna 62 and the printed circuit substrate 11 are arranged to be respectively filled with dielectric 61B and 62B made of highly dielectric material such as ceramics. Thereby, wavelength-shortening effect utilizing dielectric 61B and 62B are arranged to be attained.

Here, wavelength-shortening effect refers to an effect that wavelength is shortened by transmission speed of radio wave to be radiated from the radiation conductors 61A and 62A getting slower than in free space based on permittivity of the dielectric 61B and 62B.

That is, for transport distance L of radio wave per unit hour in free space, transport distance L' of radio wave per unit hour in dielectric gets short, and at this time frequency being same, wavelength is shortened. Accordingly, in the antenna apparatus 60, wavelength-shortening effect is arranged to be capable of miniaturizing the radiation conductors 61A and 62A.

(7) Seventh Embodiment

Figure 18:
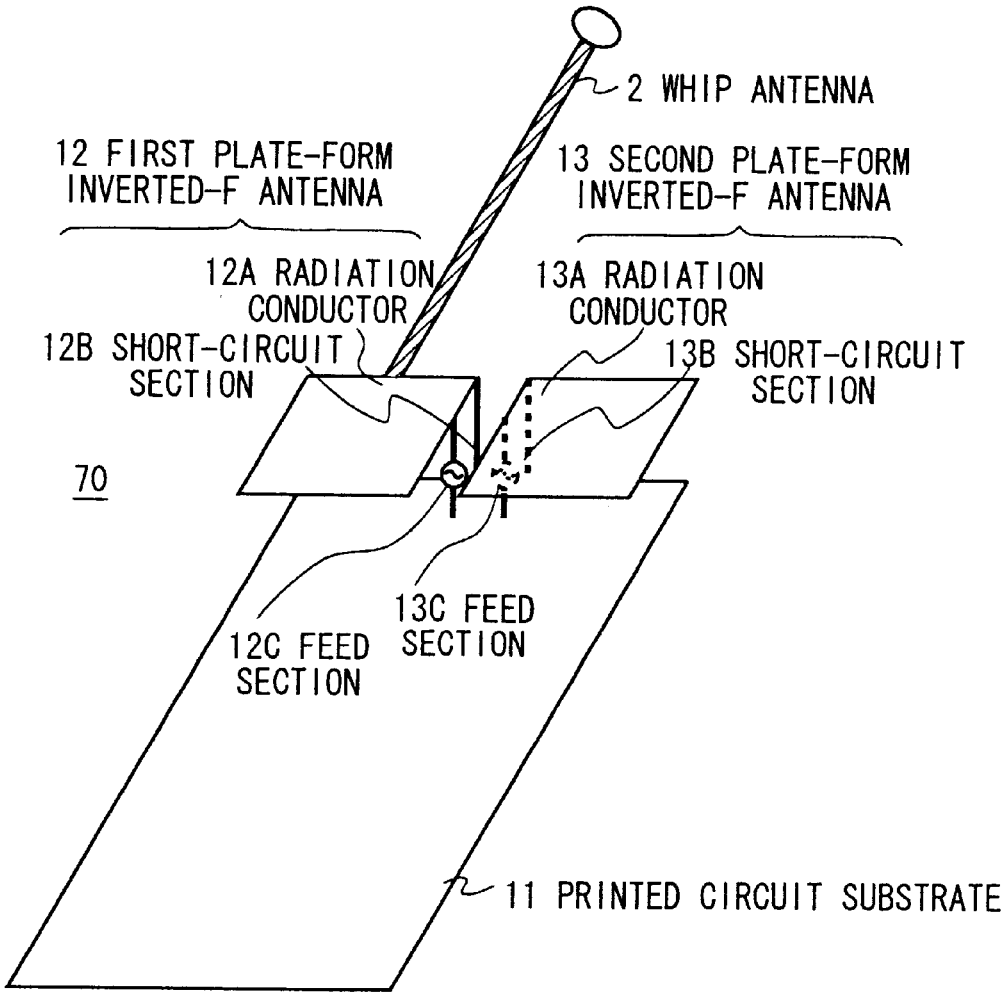
FIG. 18 is a perspective outlined view showing a configuration of an antenna apparatus in a seventh embodiment according to the present invention.

In FIG. 18 where the same reference numeral denotes its corresponding portion in FIG. 6, reference numeral 70 denotes an antenna apparatus of a seventh embodiment in its entirety in the present invention, which is configured, as in the aforementioned antenna apparatus 10 (FIG. 6), by comprising a printed circuit substrate 11, a first plate-form inverted-F antenna 12 as well as a second plate-form inverted-F antenna 13 disposed approximately parallel with a printed circuit substrate 11.

Moreover, the antenna apparatus comprises a whip antenna 2 being a line antenna. The whip antenna 2 is provided to erect from the upper end section of the printed circuit substrate 11, having selected length of around 1/4 wavelength to 1/2 wavelength. In addition, the whip antenna 2 is brought into connection with a feed section (not shown), and at the time of communication, is pulled out of a box (not shown) and in addition is housed inside the box when it is carried so as to be arranged to be used as dual-purpose antenna for transmission and reception.

This whip antenna 2 is disposed to erect from the ground, and is arranged to oscillate radio waves of vertically polarized waves when transmission is implemented under this state. Accordingly, the antenna apparatus 70 causes the whip antenna 2 to oscillate radio waves of vertically polarized waves under the state when it is caused to erect, and thereby good antenna characteristics are arranged to be obtainable since polarized waves correspond with those from the cell station 7.

Accordingly, in the antenna apparatus 70, under the state when it is caused to erect, oscillation of radio wave of vertically polarized wave by the whip antenna 2 can provide good antenna characteristics with polarized waves corresponding with those from the cell station 7 at the time when it is carried or communication is being waited. And under the state where it is caused to incline by approximately 60 degrees the first plate-form inverted-F antenna 12 and the second plate-form inverted-F antenna 13 cause current in the horizontal direction to get closer to the vertical direction so that at the time of communication the polarized waves correspond with those from the cell station 7 to provide good antenna characteristics.

Thus, the antenna apparatus 70 provides polarized waves corresponding to those from the cell station 7 with the whip antenna 2 of the vertically polarized wave when it is held vertically such as in the case of communication being waited. In addition, the antenna apparatus 70 provides polarized waves corresponding to those from the cell station 7 with the first plate-form inverted-F antenna 12 and the second plate-form inverted-F antenna 13 of horizontally polarized wave being caused to incline by 60 degrees so that radio wave of vertically polarized wave is radiated when it is held with inclination such as at the time of communication, etc., and thus polarized wave diversity effect is arranged to be attainable.

Accordingly, in the case where such an antenna apparatus 70 is installed in a portable radio communication apparatus, by always attaining the polarized wave diversity effect to cause the polarized wave to correspond with those from the cell station 7, good radio communication is all the time arranged to be realizable.

Here, the antenna apparatus 70 mainly operates with current flowing in the whip antenna 2 of vertically polarized wave and leak current flowing in the printed circuit substrate 11 in the vertical direction under the state where it is being carried or of erecting to stand by, but operates only as an antenna mainly with current flowing in the first plate-form inverted-F antenna 12 and the second plate-form inverted-F antenna 13 in the horizontal direction under the state where it is caused to incline by 60 degrees at the time of communication.

Therefore, as for the antenna apparatus 70, under the state where it is caused to incline by 60 degrees at the time of communication, the current flowing in the first plate-form inverted-F antenna 12 and the second plate-form inverted-F antenna 13 in the horizontal direction will not be accompanied by leak current taking place in the printed circuit substrate 11 so that the printed circuit substrate 11 does not operate as a section of the whip antenna 2.

Figure 19:
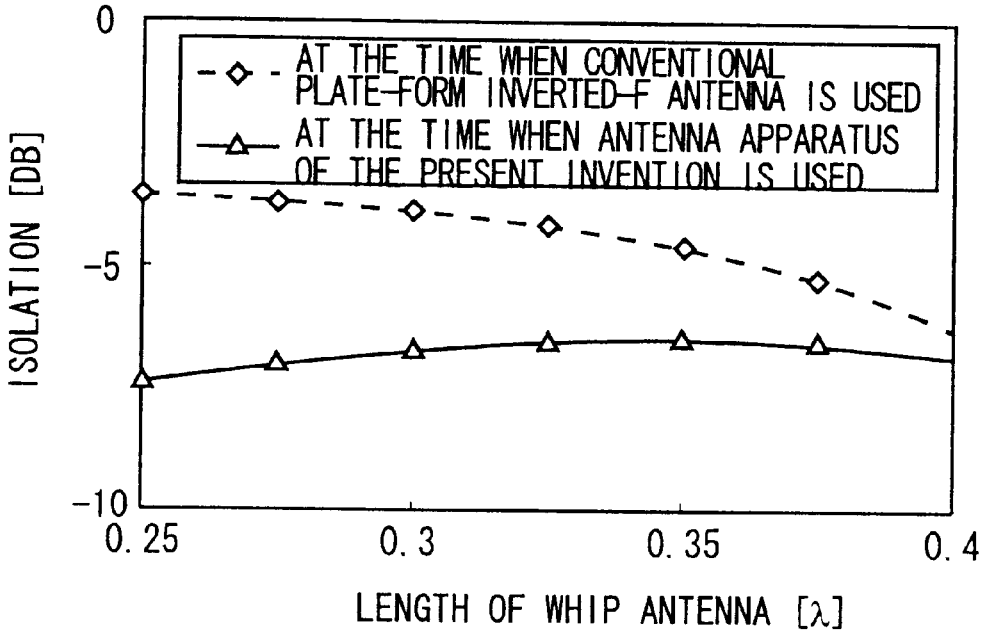
FIG. 19 is a graph featuring characteristic curves showing isolation characteristics between a whip antenna and a first as well as a second plate-form inverted-F antenna.

Thereby, the antenna apparatus 70 is arranged to attain such isolation characteristics showing excellent separation state between the whip antenna 2 and the first plate-form inverted-F antenna 12 as well as the second plate-form inverted-F antenna 13, compared with the case where a conventional plate-form inverted-F antenna 3 (FIGS. 1A and 1B) is used as shown in FIG. 19.

That is, as for the antenna apparatus 70, under the state where it is caused to incline by 60 degrees at the time of communication, deterioration of antenna characteristics due to combination of the whip antenna 2 and the first plate-form inverted-F antenna 12 as well as the second plate-form inverted-F antenna 13 is arranged to be capable of undergoing reduction certainly, compared with a conventional case.

(8) Other Embodiments

Figure 20:
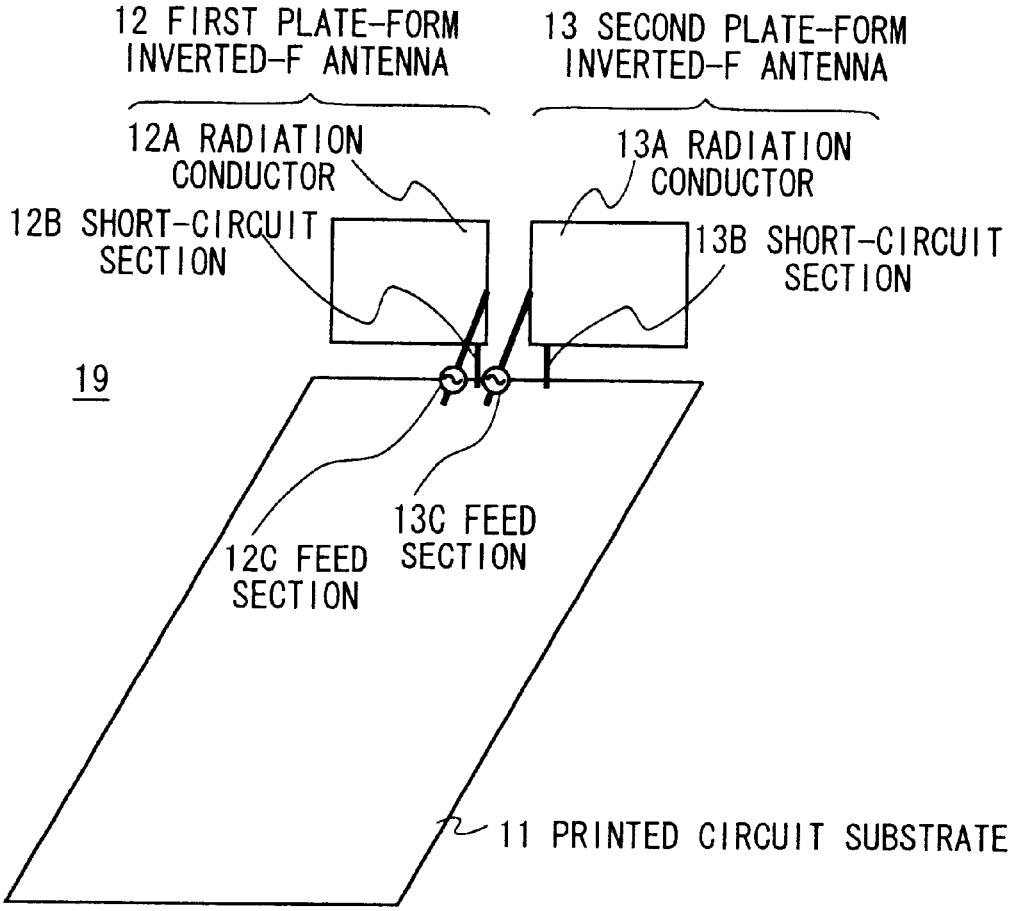
FIG. 20 is a perspective outlined view showing a configuration (1) of an antenna apparatus in another embodiment.

Incidentally, in the antenna apparatus 10 (FIG. 6) of the above described first embodiment, the case where the radiation conductors 12A and 13A are disposed approximately in parallel with the printed circuit substrate 11 has been described, but the present invention is not limited hereto, and as shown in FIG. 20, the first plate-form inverted-F antenna 12 and the second plate-form inverted-F antenna 13 can be arranged to be formed with the radiation conductors 12A and 13A being disposed under a state of having rotated by approximately 90 degrees or other various angles around the printed circuit substrate 11 as shown in FIG. 20.

In this case, the antenna apparatus 19 can house the first plate-form inverted-F antenna 12 as well as the second plate-form inverted-F antenna 13 to the interior shape of a box of the portable radio communication apparatus, and therefore can flexibly cope with further miniaturization.

Figure 21:
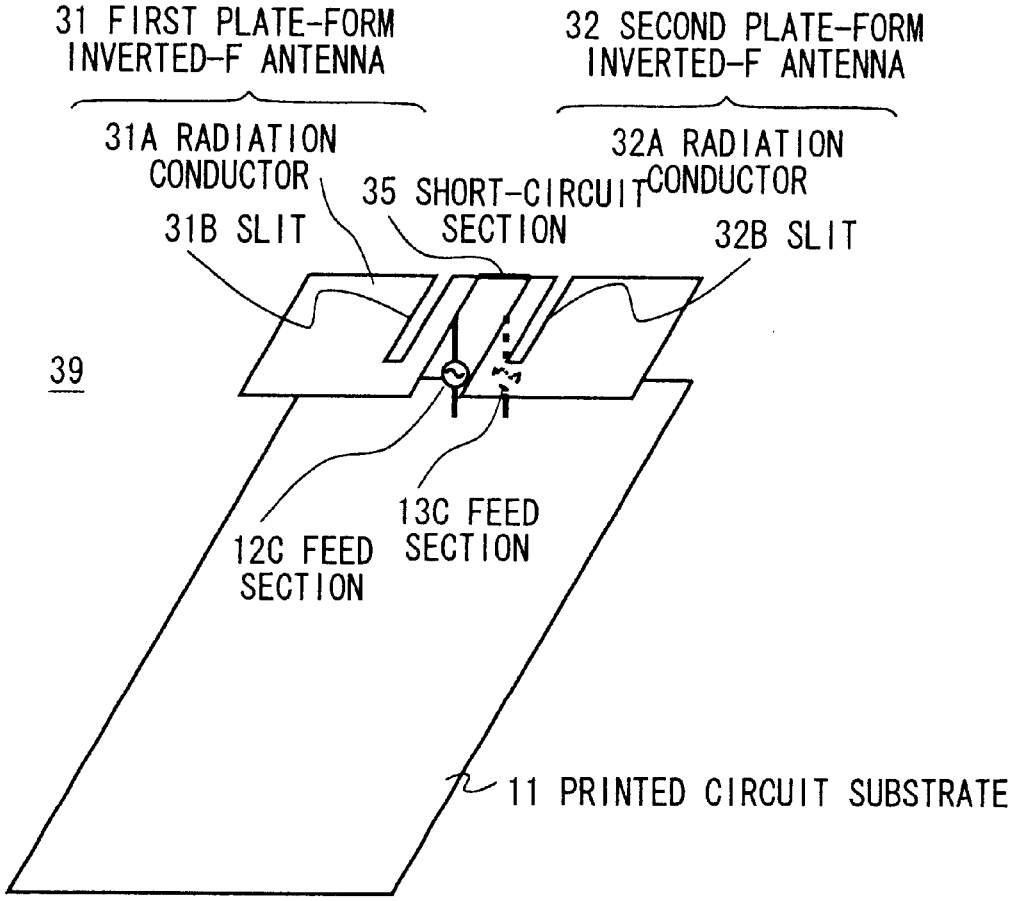
FIG. 21 is a perspective outlined view showing a configuration (2) of an antenna apparatus in another embodiment.

In addition, in the antenna apparatus 30 (FIG. 14) of the above described third embodiment, the case where the radiation conductors 31A as well as 32A and the printed circuit substrate 11 are arranged to be brought into short circuit with the short-circuit sections 12B and 13B has been described, but the present invention will not be limited hereto, and as in the antenna apparatus 20 (FIG. 13) in the second embodiment as shown in FIG. 21, the antenna apparatus 39 can be arranged to be configured with the radiation conductor 31A and the radiation conductor 32A being short-circuited with the short-circuit section 35. Also in this case, effects similar to those in the above described third embodiment can be attained.

Figure 22:
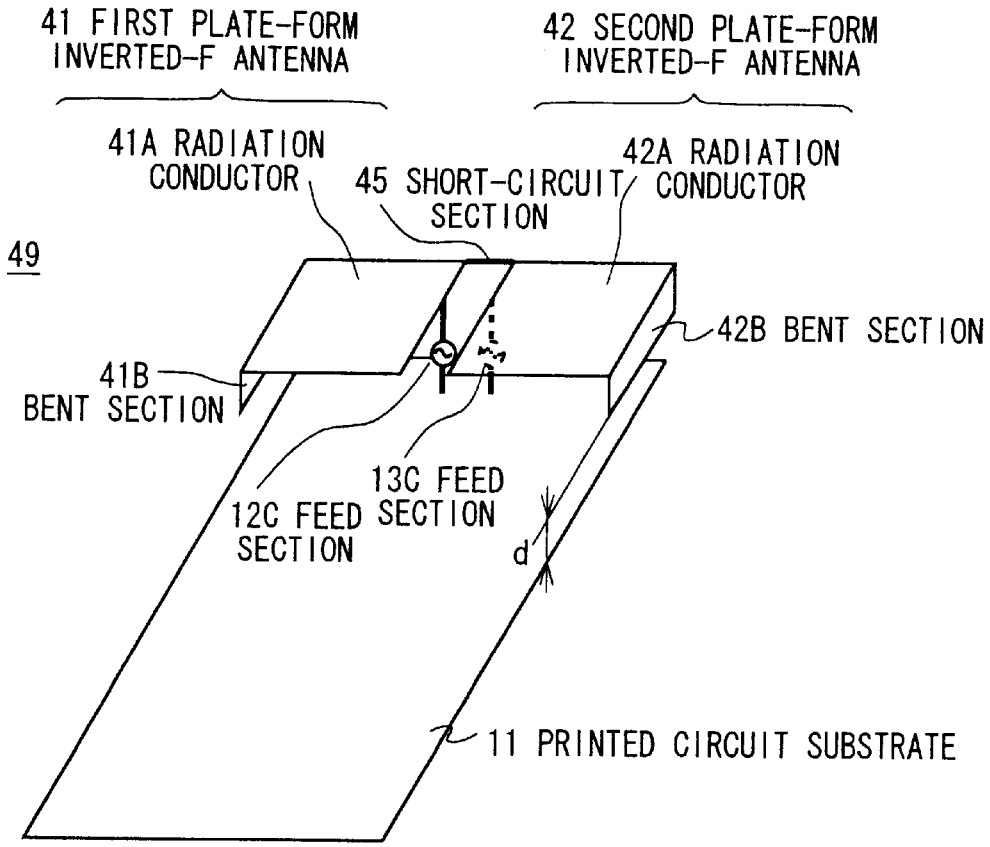
FIG. 22 is a perspective outlined view showing a configuration (3) of an antenna apparatus in another embodiment.

Moreover, in the antenna apparatus 40 (FIG. 15) of the above described fourth embodiment, the case where the radiation conductors 41A as well as 42A and the printed circuit substrate 11 are arranged to be brought into short circuit with the short-circuit sections 12B and 13B has been described, but the present invention will not be limited hereto, and as in the antenna apparatus 20 (FIG. 13) in the second embodiment as shown in FIG. 22, the antenna apparatus 49 can be arranged to be configured with the radiation conductor 41A and the radiation conductor 42A being short-circuited with the short-circuit section 45. Also in this case, effects similar to those in the above described fourth embodiment can be attained.

Figure 23:
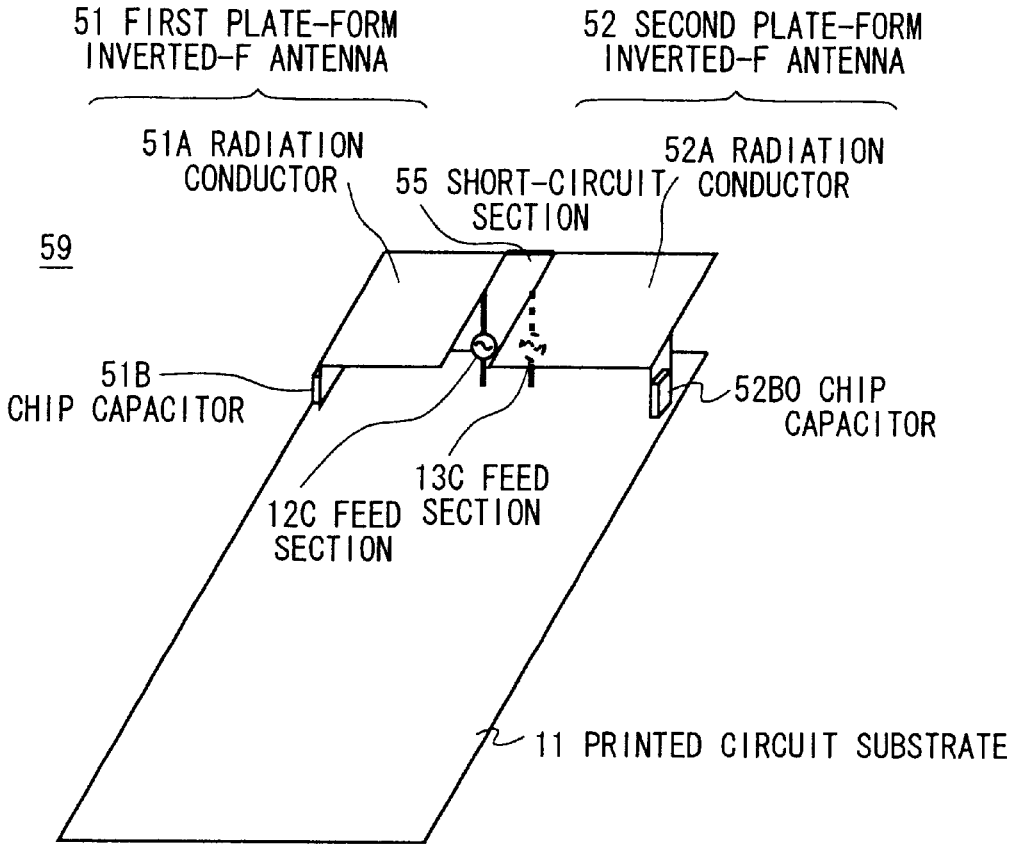
FIG. 23 is a perspective outlined view showing a configuration (4) of an antenna apparatus in another embodiment.

Moreover, in the antenna apparatus 50 (FIG. 16) of the above described fifth embodiment, the case where the radiation conductors 51A as well as 52A and the printed circuit substrate 11 are arranged to be brought into short circuit with the short-circuit sections 12B and 13B has been described, but the present invention will not be limited hereto, and as in the antenna apparatus 20 (FIG. 13) in the second embodiment as shown in FIG. 23, the antenna apparatus 59 can be arranged to be configured with the radiation conductor 51A and the radiation conductor 52A being short-circuited with the short-circuit section 55. Also in this case, effects similar to those in the above described fifth embodiment can be attained.

Figure 24:
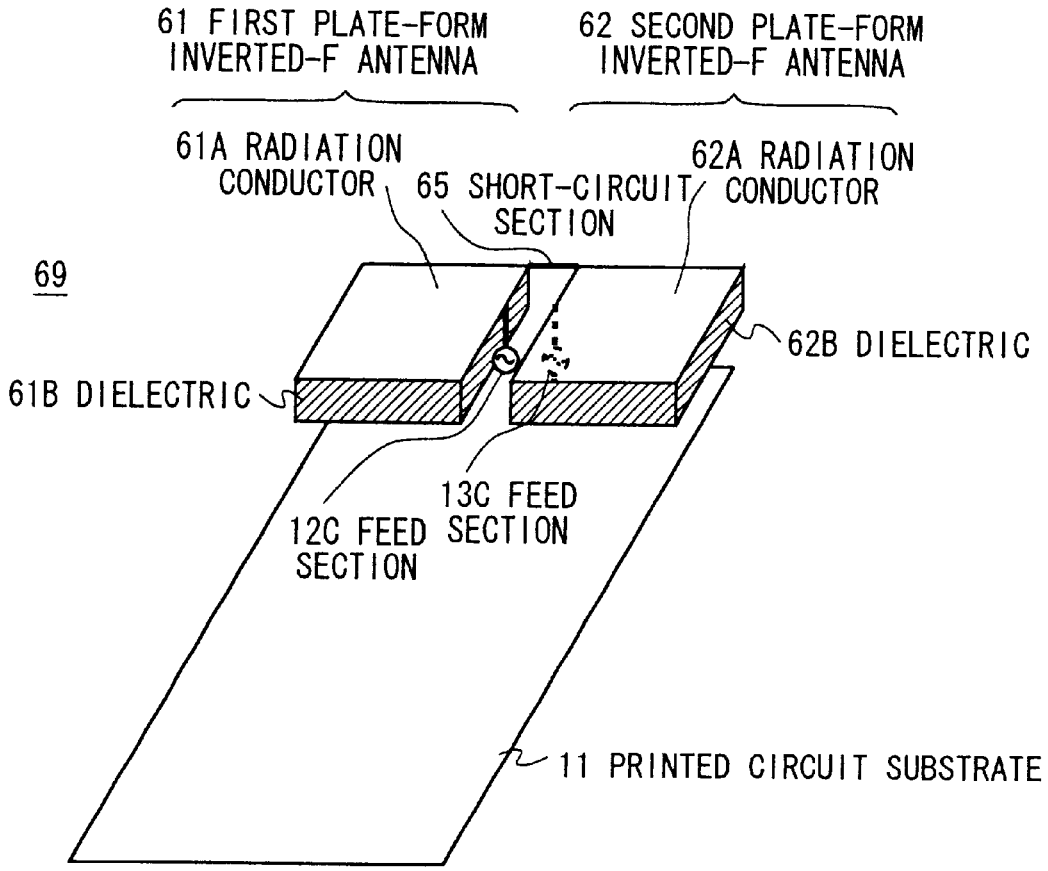
FIG. 24 is a perspective outlined view showing a configuration (5) of an antenna apparatus in another embodiment.

Moreover, in the antenna apparatus 60 (FIG. 17) of the above described sixth embodiment, the case where the radiation conductors 61A as well as 62A and the printed circuit substrate 11 are arranged to be brought into short circuit with the short-circuit sections 12B and 13B has been described, but the present invention will not be limited hereto, and as in the antenna apparatus 20 (FIG. 13) in the second embodiment as shown in FIG. 24, the antenna apparatus 69 can be arranged to be configured with the radiation conductor 61A and the radiation conductor 62A being short-circuited with the short-circuit section 65. Also in this case, effects similar to those in the above described sixth embodiment can be attained.

Figure 25:
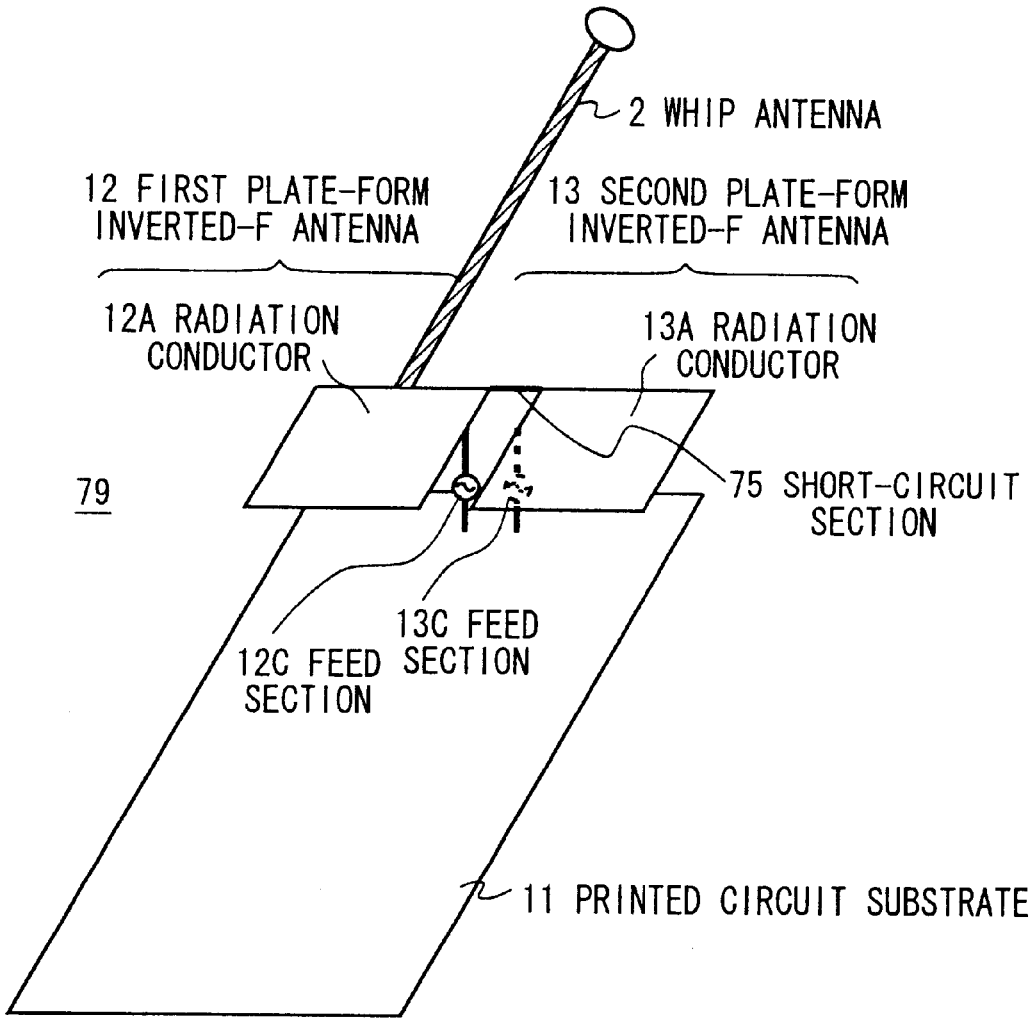
FIG. 25 is a perspective outlined view showing a configuration (6) of an antenna apparatus in another embodiment.

Moreover, in the antenna apparatus 70 (FIG. 18) of the above described seventh embodiment, the case where the radiation conductors 12A as well as 13A and the printed circuit substrate 11 are arranged to be brought into short circuit with the short-circuit sections 12B and 13B has been described, but the present invention will not be limited hereto, and as in the antenna apparatus 20 (FIG. 13) in the second embodiment as shown in FIG. 25, the antenna apparatus 79 can be arranged to be configured with the radiation conductor 12A and the radiation conductor 13A being short-circuited with the short-circuit section 75. Also in this case, effects similar to those in the above described seventh embodiment can be attained.

Moreover, in the above described first to seventh embodiments, the case where the feed section 12C and the feed section 13C are arranged to be disposed in the facing adjacent positions and the short-circuit section 12B and the short-circuit section 13B are arranged to be disposed in the facing adjacent positions has been described, but the present invention will not be limited hereto, and they can be arranged to be disposed in an adjacent position other than the facing position unless the current component flowing in the radiation conductors 12A and 13A in the horizontal direction is multiplied to give rise to leak current in the printed circuit substrate 11.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. An antenna apparatus comprising:

a ground conductor;

a first plate-form inverted-F antenna that is configured by comprising a first radiation conductor, a first feed section to supply said first radiation conductor with power, and a first short-circuit section to bring said first radiation conductor and said ground conductor into short circuit; and a second plate-form inverted-F antenna that is configured by comprising a second radiation conductor having the same characteristics as said first radiation conductor, a second feed section to supply said second radiation conductor disposed in the vicinity of said first feed section with power with phase difference of 180 degrees with respect to said first feed section, and a second short-circuit section to be disposed in the vicinity of said first short-circuit section and to bring said second radiation conductor and said ground conductor into short circuit.

2. The antenna apparatus according to claim 1, wherein said antenna apparatus brings short-circuit points respectively in said first radiation conductor and said second radiation conductor brought into connection respectively with said first short-circuit section and said second short-circuit section into electrical short circuit instead of bringing said first radiation conductor as well as said second radiation conductor and said ground conductor into short circuit with said first short-circuit section and said second short-circuit section.

3. The antenna apparatus according to claim 1, wherein said first radiation conductor and said second radiation conductor are provided with slits in a predetermined shape.

4. The antenna apparatus according to claim 1, wherein capacity is loaded in end sections of said first radiation conductor and said second radiation conductor.

5. The antenna apparatus according to claim 1, wherein dielectric is filled in between said first radiation conductor as well as said second radiation conductor and said ground conductor.

6. An antenna apparatus comprising:

a first antenna including:

a ground conductor;

a first plate-form inverted-F antenna that is configured by comprising a first radiation conductor, a first feed section to supply said first radiation conductor with power, and a first short-circuit section to bring said first radiation conductor and said ground conductor into short circuit; and a second plate-form inverted-F antenna that is configured by comprising a second radiation conductor having the same characteristics as said first radiation conductor, a second feed section to supply said second radiation conductor disposed in the vicinity of said first feed section with power with phase difference of 180 degrees with respect to said first feed section, and a second short-circuit section to be disposed in the vicinity of said first short-circuit section and to bring said second radiation conductor and said ground conductor into short circuit: and a second antenna to radiate radio wave of polarized wave different from wave of said first antenna.

7. The antenna apparatus according to claim 6, wherein said first antenna apparatus brings short-circuit points respectively in said first radiation conductor and said second radiation conductor brought into connection respectively with said first short-circuit section and said second short-circuit section into electrical short circuit instead of bringing said first radiation conductor as well as said second radiation conductor and said ground conductor into short circuit with said first short-circuit section and said second short-circuit section.

8. The antenna apparatus according to claim 6, wherein said first radiation conductor and said second radiation conductor are provided with slits in a predetermined shape.

9. The antenna apparatus according to claim 6, wherein capacity is loaded in end sections of said first radiation conductor and said second radiation conductor.

10. The antenna apparatus according to claim 6, wherein dielectric is filled in between said first radiation conductor as well as said second radiation conductor and said ground conductor.

11. A portable radio communication apparatus having an antenna apparatus comprising:

a ground conductor;

a first plate-form inverted-F antenna that is configured by comprising a first radiation conductor, a first feed section to supply said first radiation conductor with power, and a first short-circuit section to bring said first radiation conductor and said ground conductor into short circuit; and a second plate-form inverted-F antenna that is configured by comprising a second radiation conductor having the same characteristics as said first radiation conductor, a second feed section to supply said second radiation conductor disposed in the vicinity of said first feed section with power with phase difference of 180 degrees with respect to said first feed section, and a second short-circuit section to be disposed in the vicinity of said first short-circuit section and to bring said second radiation conductor and said ground conductor into short circuit.

12. The portable radio communication apparatus according to claim 11, wherein said first antenna apparatus brings short-circuit points respectively in said first radiation conductor and said second radiation conductor brought into connection respectively with said first short-circuit section and said second short-circuit section into electrical short circuit instead of bringing said first radiation conductor as well as said second radiation conductor and said ground conductor into short circuit with said first short-circuit section and said second short-circuit section.

13. The portable radio communication apparatus according to claim 11, wherein said first radiation conductor and said second radiation conductor are provided with slits in a predetermined shape.

14. The portable radio communication apparatus according to claim 11, wherein capacity is loaded in end sections of said first radiation conductor and said second radiation conductor.

15. The portable radio communication apparatus according to claim 11, wherein dielectric is filled in between said first radiation conductor as well as said second radiation conductor and said ground conductor.

16. A portable radio communication apparatus having an antenna apparatus implementing polarized wave diversity with a first antenna and a second antenna, said apparatus comprising:

said first antenna including:

a ground conductor;

a first plate-form inverted-F antenna that is configured by comprising a first radiation conductor, a first feed section to supply said first radiation conductor with power, and a first short-circuit section to bring said first radiation conductor and said ground conductor into short circuit; and a second plate-form inverted-F antenna that is configured by comprising a second radiation conductor having the same characteristics as said first radiation conductor, a second feed section to supply said second radiation conductor disposed in the vicinity of said first feed section with power with phase difference of 180 degrees with respect to said first feed section, and a second short-circuit section to be disposed in the vicinity of said first short-circuit section and to bring said second radiation conductor and said ground conductor into short circuit: and a second antenna to radiate radio wave of polarized wave different from wave of said first antenna.

* * * * *